US006057026A

United States Patent [19]

Tsuchiya et al.

[11] Patent Number: 6,057,026

[45] Date of Patent: May 2, 2000

[54] RECORDING SHEET FOR INK-JET RECORDING AND INK JET

[75] Inventors: Ichiro Tsuchiya; Hiroyuki Uemura, both of Hino, Japan

[73] Assignee: Konica Corporation, Japan

[21] Appl. No.: 09/008,980

[22] Filed: Jan. 20, 1998

[30] Foreign Application Priority Data

Jan. 24, 1997 [JP] Japan ..... 9-011253

[51] Int. Cl.[7] ..... B41M 5/00

[52] U.S. Cl. ..... 428/195; 428/480; 428/500; 428/511; 428/513; 428/537.5; 428/704; 347/105

[58] Field of Search ..... 428/195, 212, 428/411.1, 480, 500, 511, 513, 704, 537.5; 347/100, 105, 106; 427/258, 268, 288; 162/134, 135, 137, 162

[56] References Cited

U.S. PATENT DOCUMENTS

| | | | |
|---|---|---|---|
| 3,575,704 | 4/1971 | Salesin . | |
| 5,192,738 | 3/1993 | Inagaki et al. | 503/227 |
| 5,892,033 | 4/1999 | Komamura et al. | 544/225 |

FOREIGN PATENT DOCUMENTS

| | | |
|---|---|---|
| 62-263084 | 11/1987 | Japan . |
| 63-301888 A2 | 12/1988 | Japan . |
| 1-146784 | 6/1989 | Japan . |
| 6-064306 | 3/1994 | Japan . |

*Primary Examiner*—Marie Yamnitzky
*Attorney, Agent, or Firm*—Jordan B. Bierman; Bierman, Muserlian and Lucas

[57] ABSTRACT

A recording sheet for ink-jet recording comprising a support, and provided on one side of the support, an ink receiving layer, wherein the ink receiving layer contains a compound represented by the following formula I:

formula I wherein $Q^1$ and $Q^2$ independently represent a non-metallic atomic group necessary to form an acidic nitrogen-containing heterocyclic ring; $L^1$, $L^2$, and $L^3$ independently represent a substituted or unsubstituted methine group; M represents a cationic group; m represents an integer of 0 to 4; and n represents a number necessary to neutralize the charge of the molecule.

16 Claims, No Drawings

RECORDING SHEET FOR INK-JET RECORDING AND INK JET

FIELD OF THE INVENTION

The present invention relates to a recording sheet for ink-jet recording to be recorded with water based ink, and particularly to a recording sheet for ink-jet recording with excellent water resistance, which can provide an image with excellent resolving power and uniformity.

BACKGROUND OF THE INVENTION

An ink jet recording apparatus (hereinafter referred to also as an ink-jet printer) enables high speed recording with low noise and makes it easy to form a color image by employing plural ink nozzles. Recently, the ink-jet recording printer is rapidly spreading as an image formation output apparatus for a computer. Further, it has been applied to preparation of a color original or design image in which a high quality image corresponding to a photographic image is required. Specifically, in the field of graphic art and designing requiring high quality images, its utilization is being taken notice of.

As Ink for ink jet recording, a water based ink having, as main components, water and a water soluble organic solvent has been used in view of safety or recording properties, so that ink clogging of nozzles is minimized. As a recording sheet used for ink-jet recording system, conventionally, paper or a recording sheet referred to as an ink-jet recording paper wherein a porous ink-absorption layer is provided on a support has been used.

However, the above-mentioned recording papers result in much ink blurring and low glossiness, and could not be employed for the above-mentioned field wherein high quality image is required. The porous ink absorbing layer coated on a glossy resin-covered paper has a rough surface and causes light scattering, resulting in the problem that transparency and glossiness are lowered. The non-porous ink absorbing layer increases light transmittance, but there was the problem that ink after ink recording remains without being dried on the surface for a long time, and requires a long drying time.

In order to overcome the above-mentioned problems, there is proposed a gelatin containing layer as an ink-absorption layer with high transparency and high ink-receptivity. For example, an ink receiving layer comprised of gelatin having a specific pH is proposed in Japanese Patent O.P.I. Publication No. 62-263084, a combination use of gelatin and a surfactant is proposed in Japanese Patent O.P.I. Publication No. 1-146784, and a recording sheet, which is obtained by coating a gelatin layer on a support to be in gel state and then drying it by a cold drying method, is proposed in Japanese Patent O.P.I. Publication No. 6-64306.

The ink receiving layer having gelatin provides excellent ink absorption, and high glossiness. However, it has been proved that it has disadvantage that the tone of the ink receiving layer surface varies after a long term storage, particularly under high humidity.

SUMMARY OF THE INVENTION

A first object of the present invention is to provide a recording sheet for ink-jet recording with excellent storage stability, and high glossiness which provides a high quality image.

A second object of the present invention is to provide a recording sheet for ink-jet recording having an image receiving layer, wherein the sheet can provide an image with excellent resolving power and uniformity.

DETAILED DESCRIPTION OF THE INVENTION

The present inventors have made an extensive study, and as a result, the above objects of the invention can be attained by adding a specific compound to the ink receiving layer of the recording sheet. That is, the above objects of the invention can be attained by the following:

1. A recording sheet for ink-jet recording comprising a support, and provided on one side of the support, an ink receiving layer, wherein the ink receiving layer contains at least one of compounds represented by the following formula I:

formula I

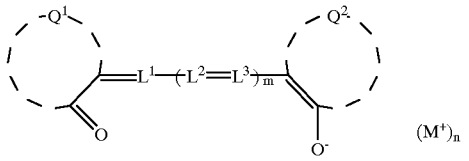

wherein $Q^1$ and $Q^2$ independently represent a non-metallic atomic group necessary to form an acidic nitrogen-containing heterocyclic ring; $L^1$, $L^2$, and $L^3$ independently represent a substituted or unsubstituted methine group; M represents a cationic group; m represents an integer of 0 to 4; and n represents a number necessary to neutralize the charge of the molecule, 2. the recording sheet for ink-jet recording of 1 above, wherein the content of the compound in the ink receiving layer is 0.01 to 10 mg/m$^2$,
3. the recording sheet for ink-jet recording of 1 or 2 above, wherein the ink receiving layer contains a water soluble polymer,
4. the recording sheet for ink-jet recording of 3 above, wherein the water soluble polymer is selected from the group consisting of gelatin, polyvinyl pyrrolidones, polyvinyl alcohols and polyalkylene glycols,
5. the recording sheet for ink-jet recording of 1, 2, 3 or 4 above, wherein the support is comprised of a hydrophobic substrate,
6. the recording sheet for ink-jet recording of 5 above, wherein the hydrophobic substrate is a resin-coated paper in which a resin is provided on both sides of a base paper,
7. the recording sheet for ink-jet recording of 6 above, wherein the resin is polyolefin,
8. the recording sheet for ink-jet recording of 7 above, wherein the polyolefin is polyethylene,
9. the recording sheet for ink-jet recording of 5 above, wherein the hydrophobic substrate is a polyester resin film,
10. the recording sheet for ink-jet recording of 9 above, wherein the polyester resin film is a polyethylene terephthalate film,
11. the recording sheet for ink-jet recording of 1, 2, 3, 4, 5, 6, 7, 8, 9, or 10 above, wherein the ink receiving layer contains at least two of compounds represented by formula I,
12. the recording sheet for ink-jet recording of 1 through 11 above, wherein the compound represented by said formula I is localized in the ink receiving layer closer to the support, 13. the recording sheet for ink-jet recording of 1 through 11 above, wherein 80 weight % or more of the compound represented by said formula I are localized in the ink receiving layer within 50% of the ink receiving layer thickness, measured from the support, 14. the recording sheet for ink-jet recording of 1 through 11 above, wherein the ink receiving layer consists of at least two layers and the ink receiving layer closest to the support contains the compound represented by said formula I, or 15. an ink jet recording method employing a color ink jet recording procedure, the method comprising the step of:

jetting ink on an ink jet recording sheet comprising a support, and provided on one side of the support, an ink receiving layer, wherein the ink receiving layer contains a compound represented by the following formula I:

formula I

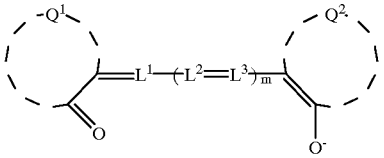

$(M^+)_n$ wherein $Q^1$ and $Q^2$ independently represent a non-metallic atomic group necessary to form a nitrogen-containing heterocyclic ring; $L^1$, $L^2{}_1$ and $L^3$ independently represent a methine group; M represents a cationic group; m represents an integer of 0 to 4; and n represents a number necessary to neutralize the charge of the molecule.

The present invention will be detailed below.

The compound represented by formula I used in the invention will be explained below.

formula I

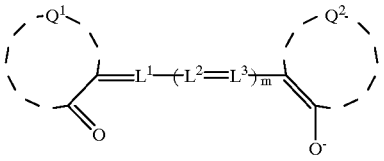

$(M^+)_n$ wherein $Q^1$ and $Q^2$ independently represent a non-metallic atomic group necessary to form an acidic nitrogen-containing heterocyclic ring; $L^1$, L2, and $L^3$ independently represent a substituted or unsubstituted methine group; M represents a cationic group; m represents an integer of 0 to 4; and n represents a number necessary to neutralize the charge of the molecule.

In formula I, $Q^2$ represents an enol isomer to which $Q^1$ with a keto structure is tautomerized, and an acidic nitrogen-containing heterocyclic ring, which $Q^1$ combines with the carbons $Q^1$ bonds to form, includes the following:

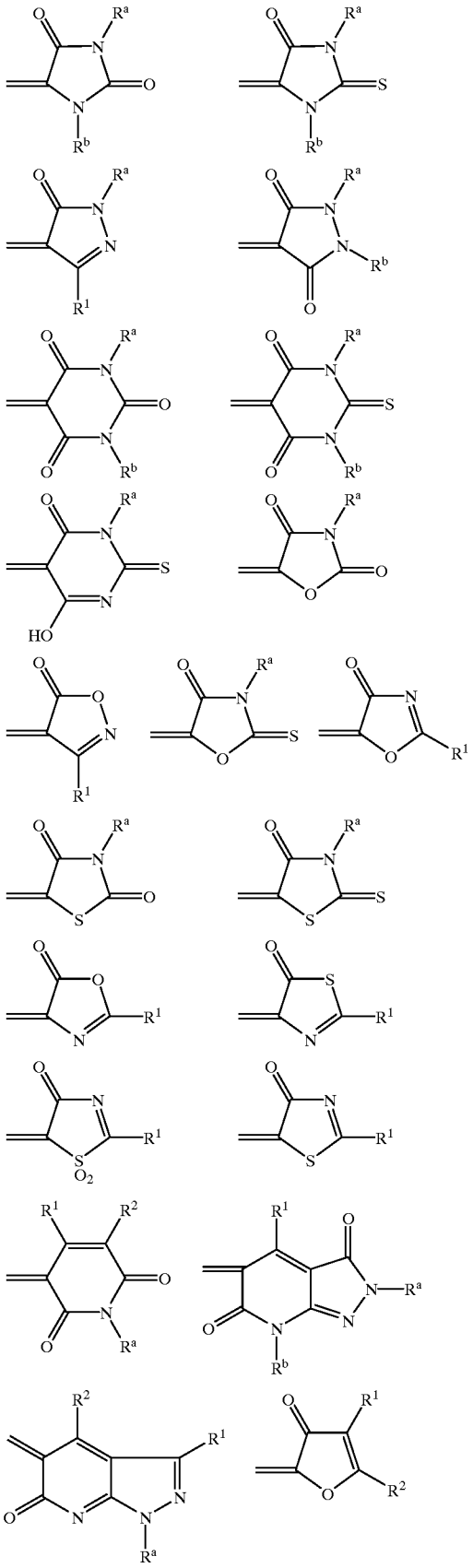

$R^1$ and $R^2$ independently represent a hydrogen atom, an alkyl group, an aryl group, a heterocyclic group, a carbamoyl group, an amino group, a hydroxy group, a carboxyl group, an alkyloxycarbonyl group, an aryloxycarbonyl group a cyano group, an acyl group, a sulfamoyl group, an alkoxy group, or an aryloxy group; and $R^a$ and $R^b$ independently represent a hydrogen atom, an alkyl group, an aryl group, a heterocyclic group, a carbamoyl group, or a sulfonyl group.

The alkyl group represented by $R^1$ and $R^2$, or $R^a$ and $R^b$ includes a straight-chained alkyl such as ethyl, ethyl, propyl, or isopropyl, cyclic alkyl such as cyclopropyl, cyclopentyl, and cyclohexyl, each of which may have a substituent such as 2-sulfoethyl, 2-sulfobutyl, benzyl, allyl, o-sulfobenzyl, p-carboxybenzyl, carboxymethyl, ethoxycarbonylmethyl, trifluoroethyl or trifluoromethyl.

The aryl group represented by $R^1$ and $R^2$, or $R^a$ and $R^b$ includes phenyl and naphthyl. The heterocyclic group represented by $R^1$ and $R^2$, or $R^a$ and $R^b$ includes pyridyl, thienyl, sulfolanyl, indolyl, indazolyl, piperidyl, pyrrolyl, pyrazyl and thiazolyl, each of which may have a substituent such as 4-sulfophenyl, 2,5-disulfophenyl, 4-cyanophenyl, 4-carboxyphenyl, 4-sulfamoylphenyl, 2,5-bis(N,N-dimethyl-sulfamoylphenyl, 4-butanesulfonamidophenyl, 4-chloro-2-pyridyl, 1-methyl-2-imidazolyl or 5-methyl-2-furyl.

The acyl group represented by $R^1$ and $R^2$, or $R^a$ and $R^b$ includes acetyl, benzoyl and propionyl. The carbamoyl group represented by $R^1$ and $R^2$, or $R^a$ and $R^b$ includes carbamoyl, N-methylcarbamoyl, morpholinocarbonyl, piperazinocarbonyl, N,N-dimethylcarbamoyl and N-propylcarbamoyl.

The amino group represented by $R^1$ and $R^2$, or $R^a$ and $R^b$ includes amino, and an amino group having a substituent such as N-methylamino, N, N-diethylamino, N-benzylamino, N-acetylamino, N-benzoylamino, N-propionylamino, N-2-pyridylamino, succinic imino, methanesulfonyl amino, ethanesulfonylamino, and butane-ethanesulfonylamino. The alkyloxycarbonyl group represented by $R^1$ and $R^2$, or $R^a$ and $R^b$ includes methoxycarbonyl, ethoxycarbonyl, 2-methoxyethoxycarbonyl, 2-ethoxyethoxycarbonyl, and 2,2,2-trifluoroethoxycarbonyl. The aryloxycarbonyl group represented by $R^1$ and $R^2$, or $R^a$ and $R^b$ includes phenoxycarbonyl and p-methoxycarbonyl.

The sulfamoyl group represented by $R^1$ and $R^2$, or $R^a$ and $R^b$ includes sulfamoyl, N-benzylsulfamoyl, N,N-(3-oxapentamethylene)sulfamoyl, and N,N-pentamethylene) sulfamoyl. The alkoxy group represented by $R^1$ and $R^2{}_1$ or $R^a$ and $R^b$ includes methoxy, ethoxy, butoxy, 2-methoxyethoxy, 2-hydroxyethoxy, 2-phenoxyethoxy, 2-hydroxypropoxy, 2-(2-hydroxyethoxy)ethoxy, 2-cyanoethoxy and 2-chloroethoxy. The aryloxy group represented by $R^1$ and $R^2{}_1$ or $R^a$ and $R^b$ includes phenoxy, 2-naphthoxy, 1-naphthoxy, p-naphthoxy, p-carboxynaphthoxy, p-sulfamoylphenoxy and p-caramoylphenoxy.

The sulfonyl group represented by $R^a$ and $R^b$ includes methanesulfonyl, ethanesulfonyl, butanesulfonyl, p-toluenesulfonyl, and benzenesulfonyl.

The cationic group represented by M+ includes a hydrogen ion, an alkali metal ion such as a lithium ion or a potassium ion, an ammonium ion, an alkali earth metal ion such as a calcium ion or a magnesium ion, and an organic ammonium ion such as a triethanolammonium ion or a triethylammonium ion.

The methine group represented by $L^1$, $L^2$ and $L^3$ may have a substituent such as methy, ethyl, phenyl or benzyl.

In formula I, the preferable acidic nitrogen-containing heterocyclic group formed by $Q^1$ and $Q^2$ includes 5-pyrazolone ring group, a 2,6-pyridine-dione ring group, a 3,5-pyrazoline-dione group, a 2,4,6-pyridine-trione group, and a 2-thio-2,4,6-pyrimidine-trione group.

The compound represented by formula I includes those represented by the following formulas I-a, I-b, I-c, I-d and I-e:

formula I-a

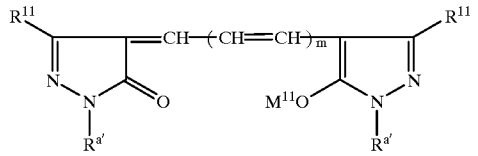

formula I-b

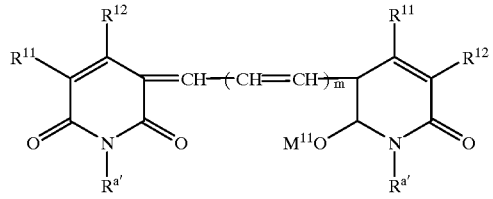

formula I-c

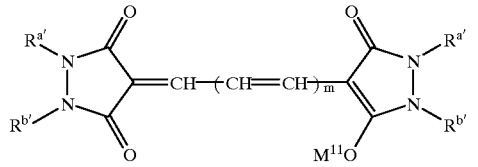

formula I-d

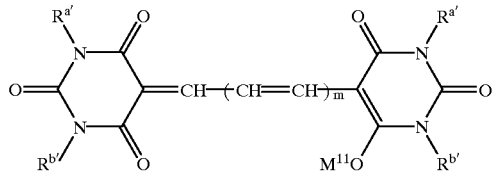

formula I-e

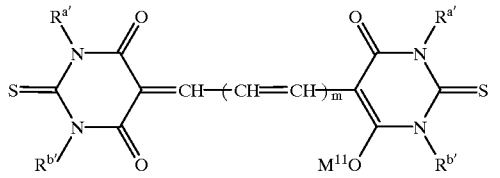

In formulas 1-a through 1-e, $R^{11}$ and $R^{12}$ independently represent those as denoted in $R^1$ and $R^2$ in formula I, $R^a$ and $R^b$ independently represent those as denoted in $R^a$ and $R^b$ in formula I, and $M^{11}$ represents those as denoted in M in formula I. Exemplified compounds thereof are listed below.

Exemplified compounds of formula I-a
a-1
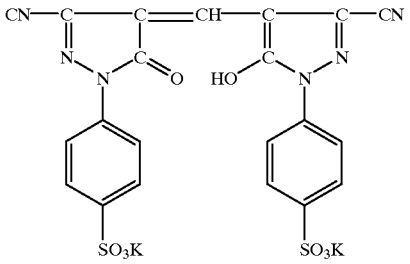
a-2
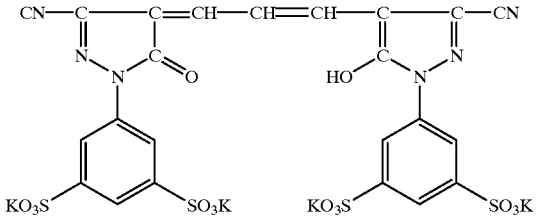
a-3
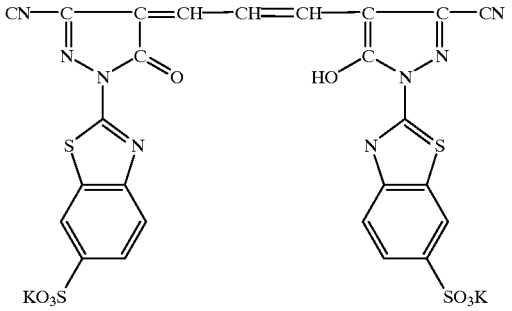
a-4
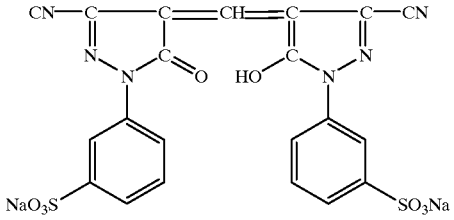
a-5
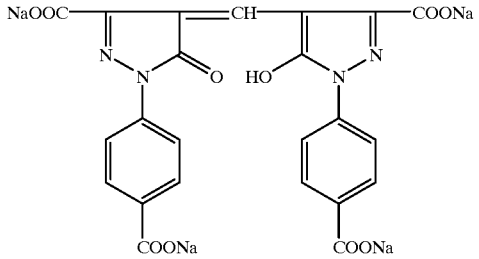

-continued
a-6
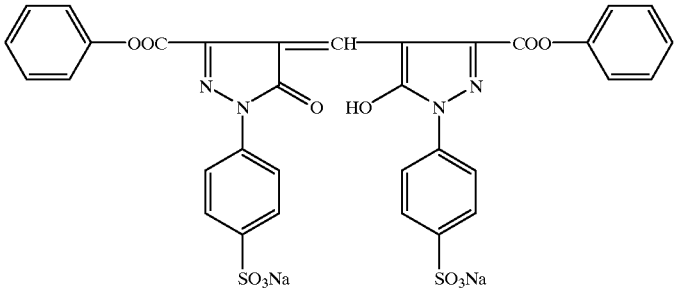
a-7
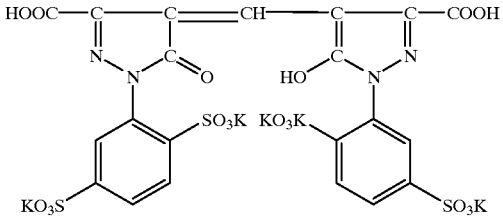
a-8
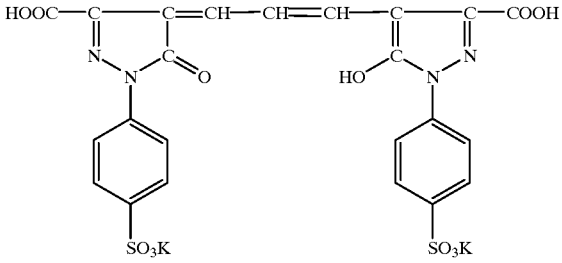
a-9
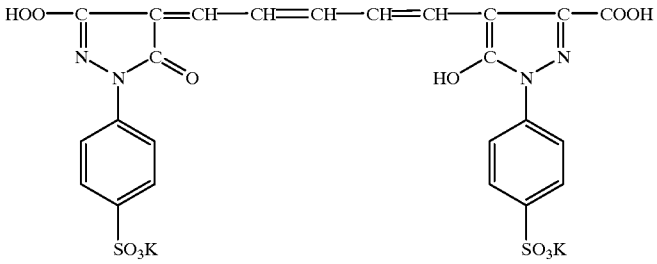
a-10
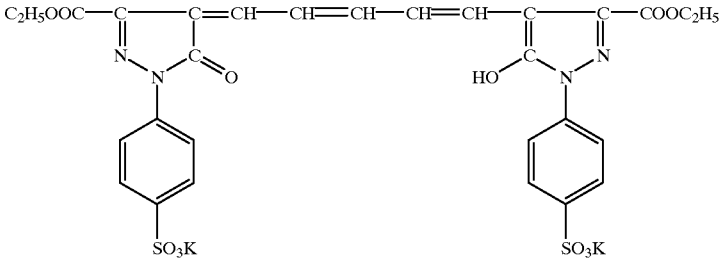
a-11
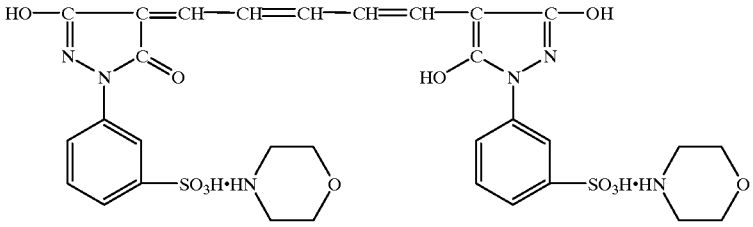

-continued
a-12
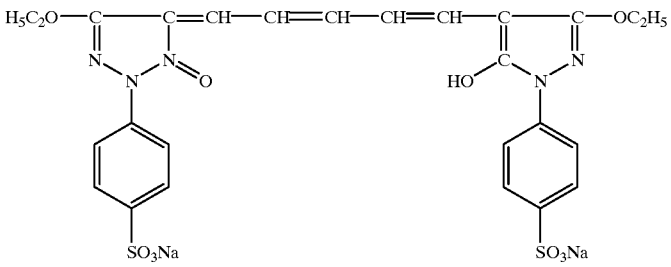
a-13
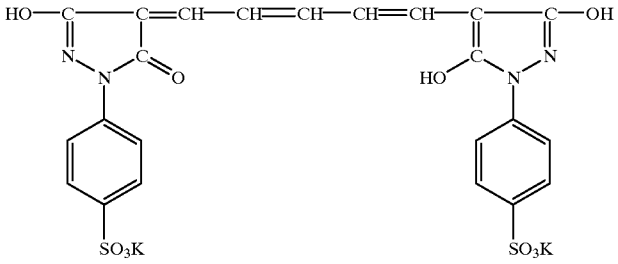
a-14
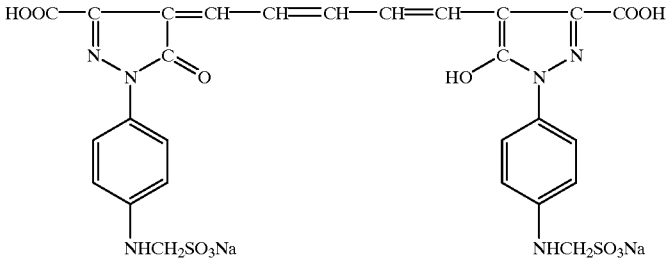
a-15
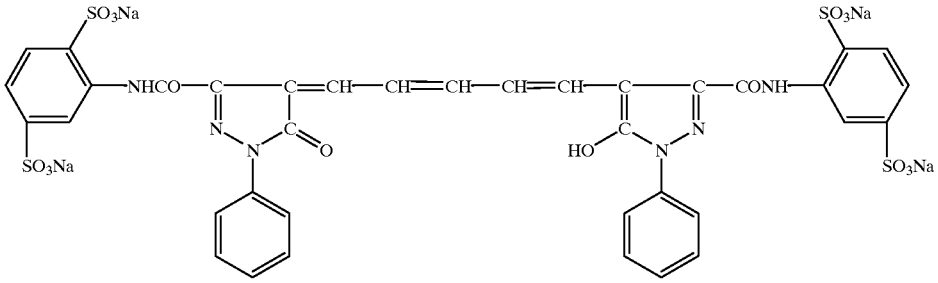
a-16
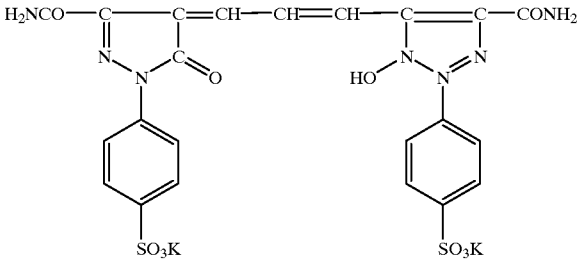

-continued
a-17
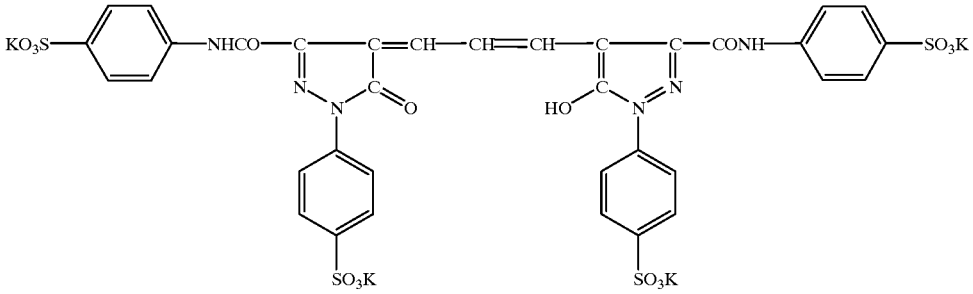
a-18
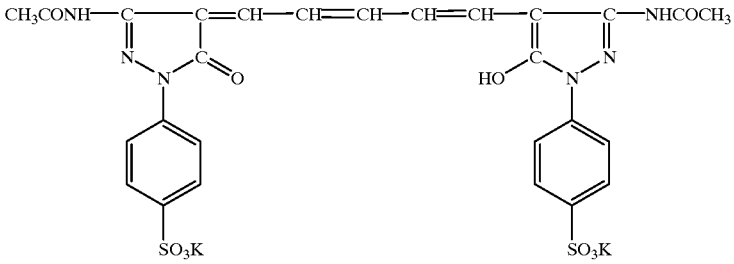
a-19
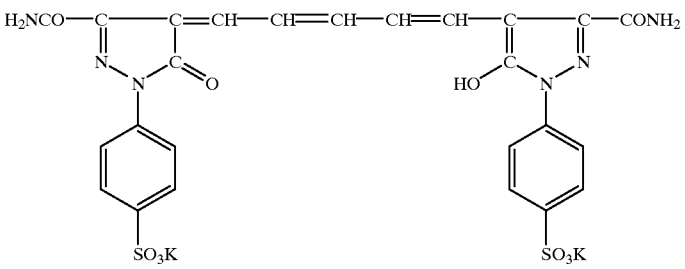
a-20
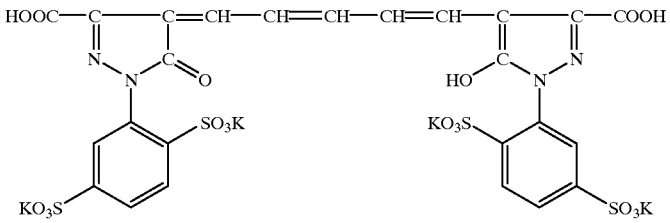
a-21
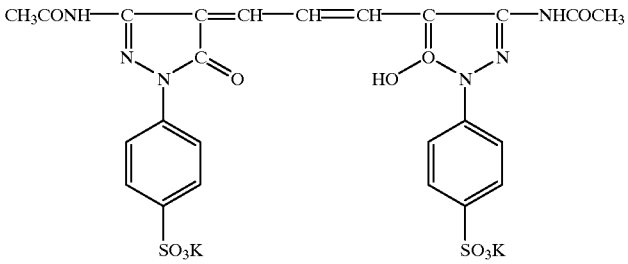
a-22
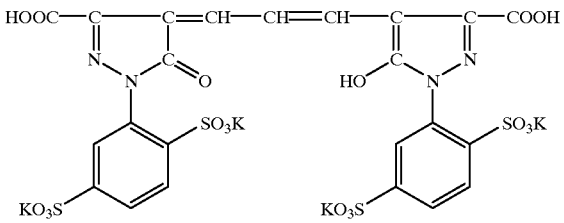

-continued
a-23
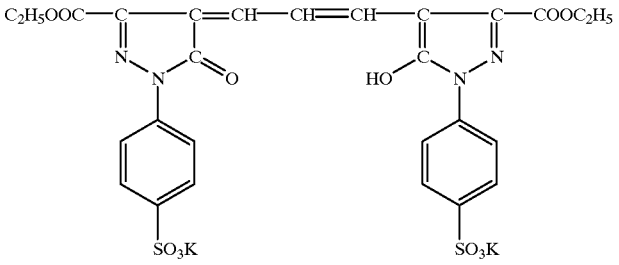
a-24
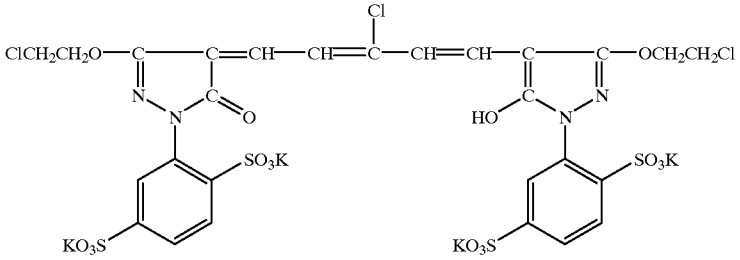
a-25
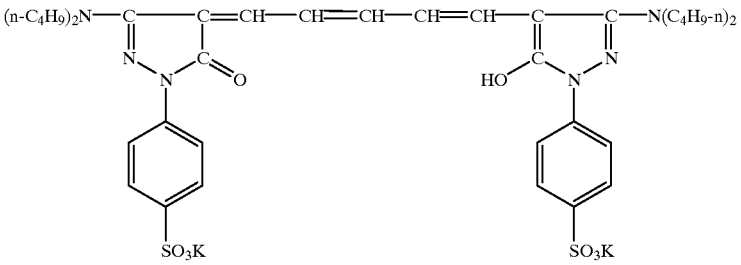
a-26
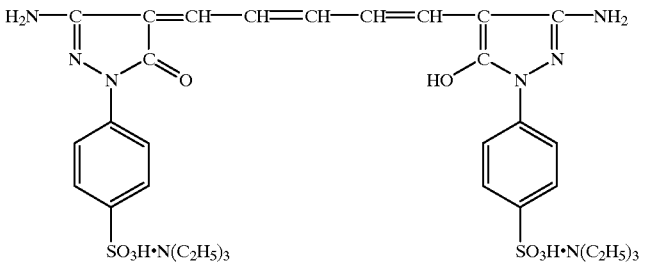
a-27
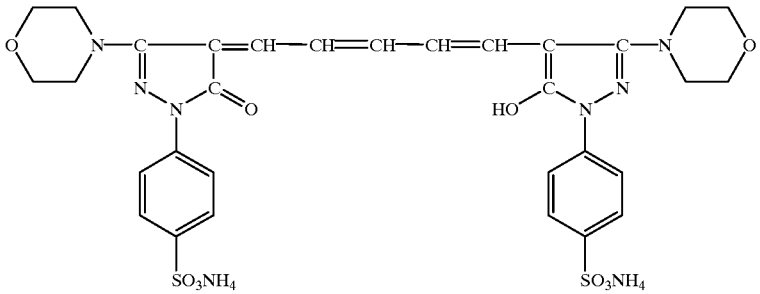
a-28
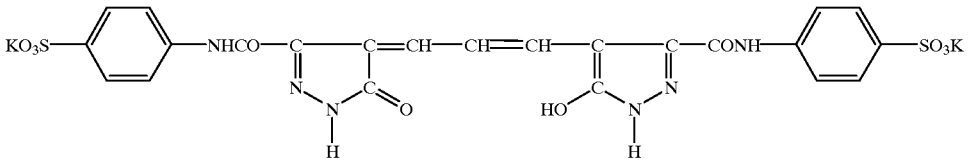

-continued
a-29
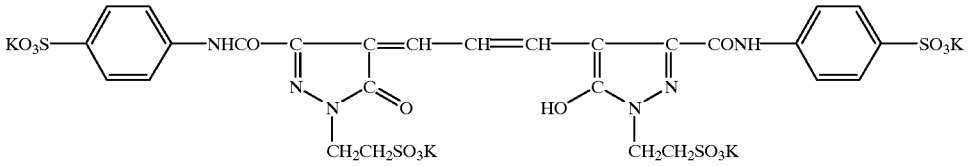
a-30
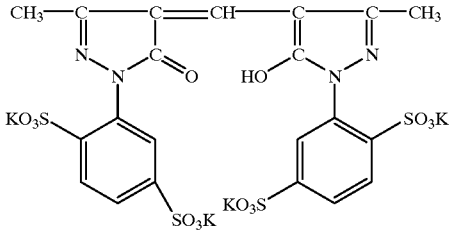
Exemplified compounds of formula I-b
b-1
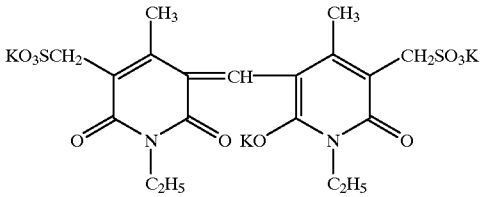
b-2
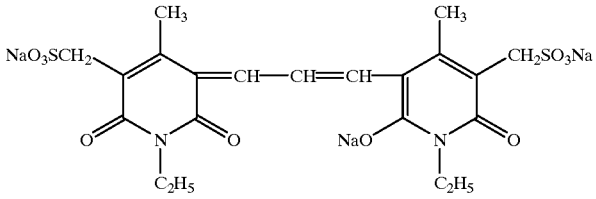
b-3
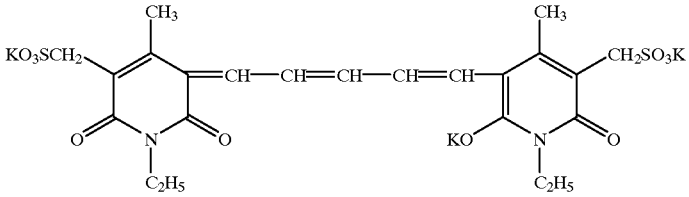
b-4
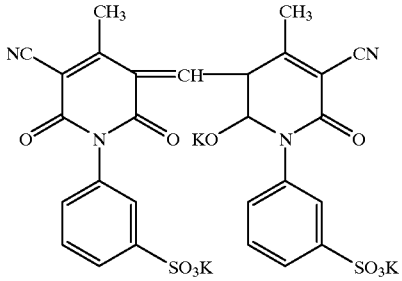

-continued
b-5
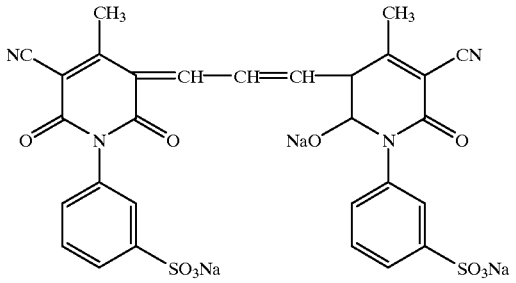
b-6
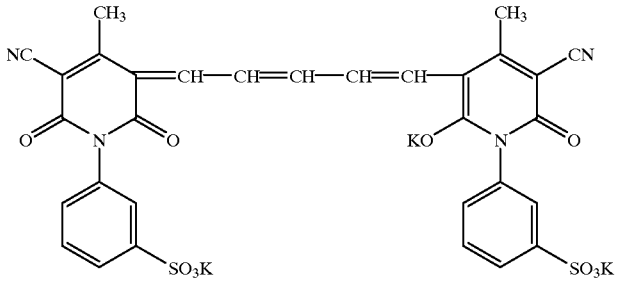
b-7
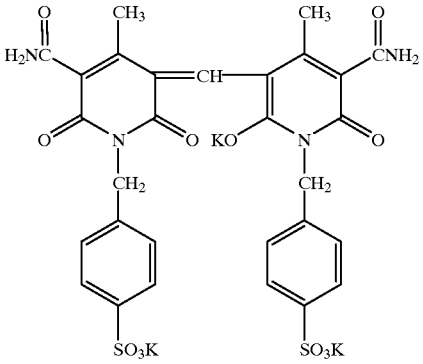
b-8
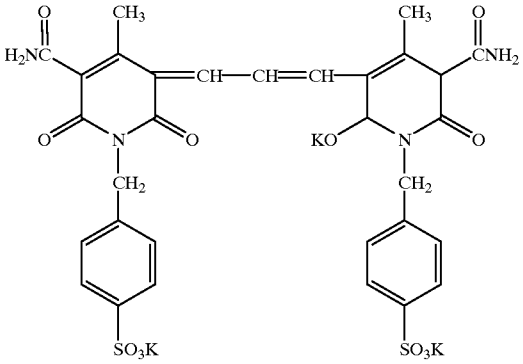

-continued
b-9
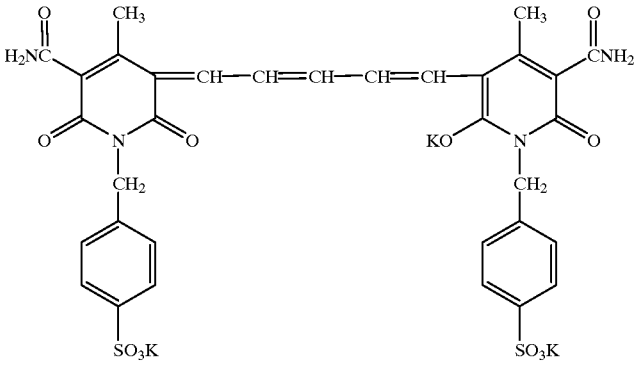
b-10
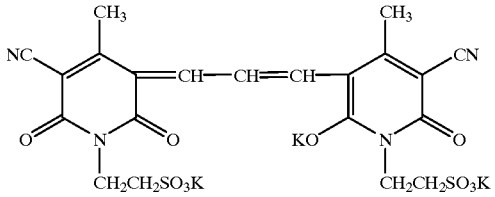
b-11
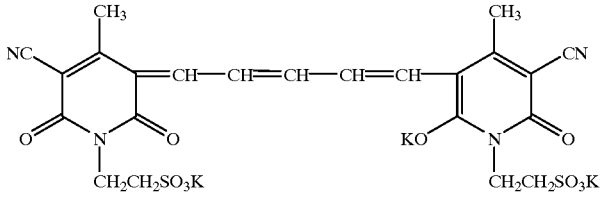
b-12
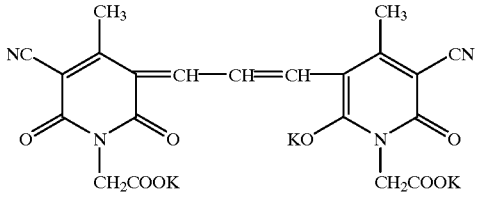
b-13
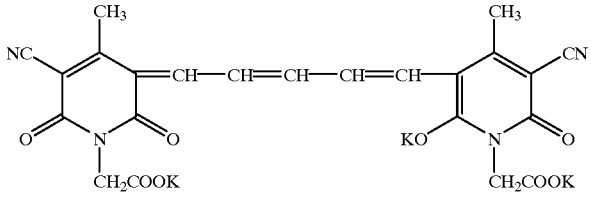
b-14
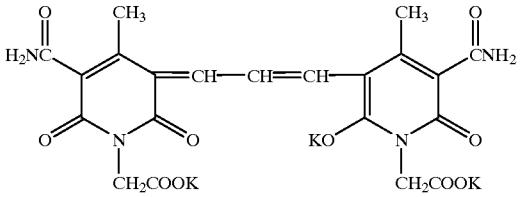

-continued
b-15
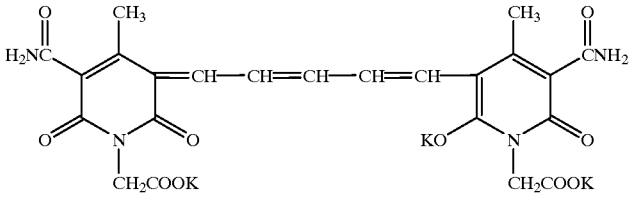
b-16
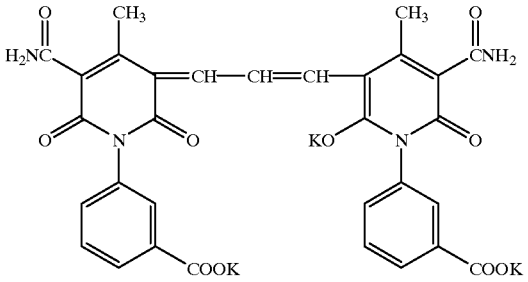
b-17
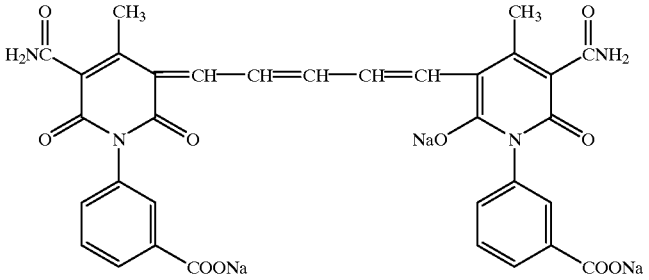
b-18
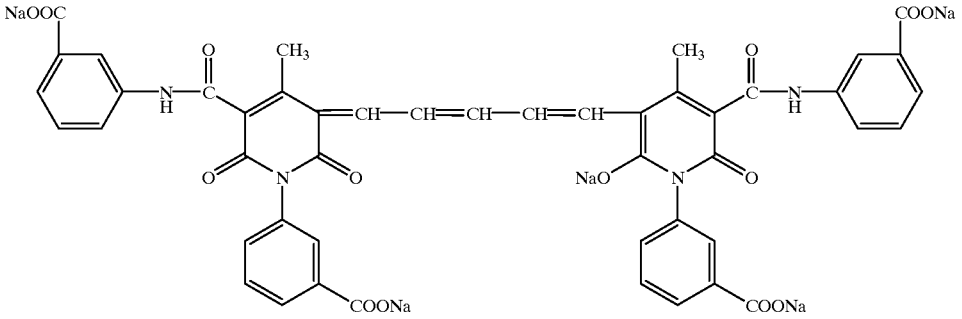
b-19
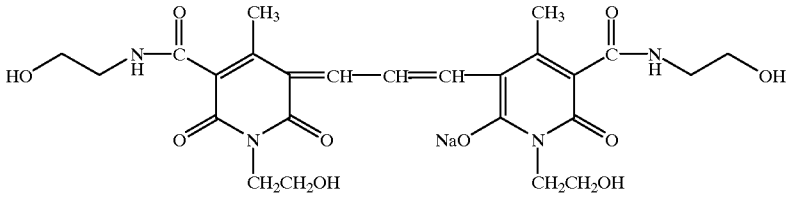
b-20
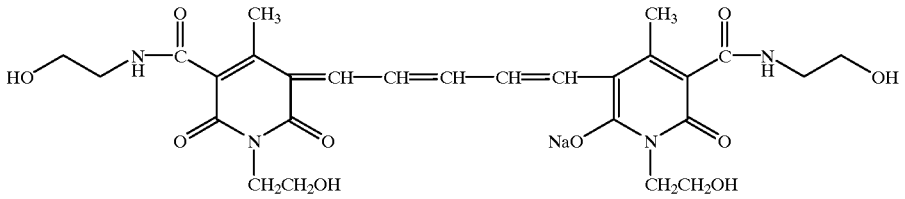

-continued
b-21
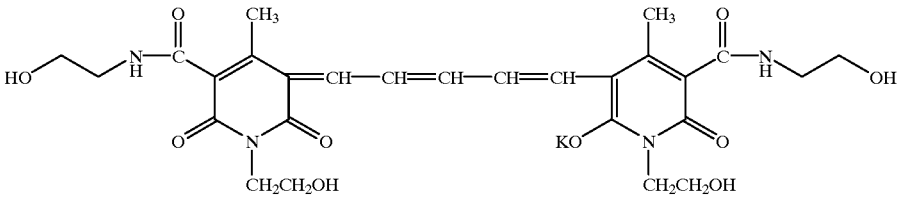
b-22
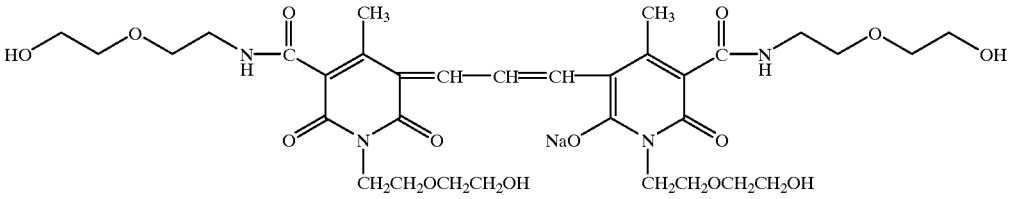
b-23
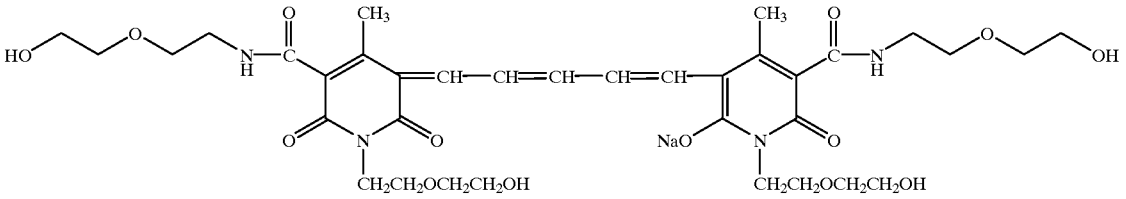
b-24
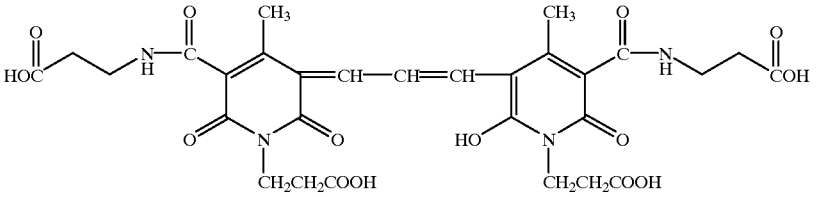
b-25
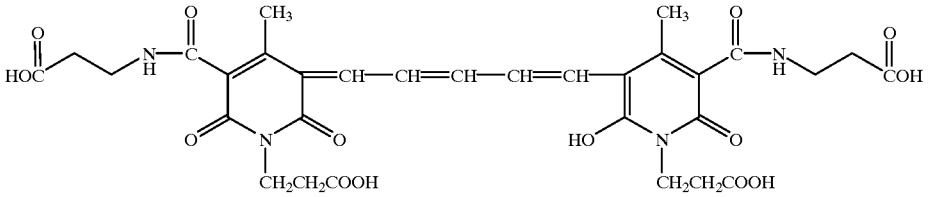
b-26
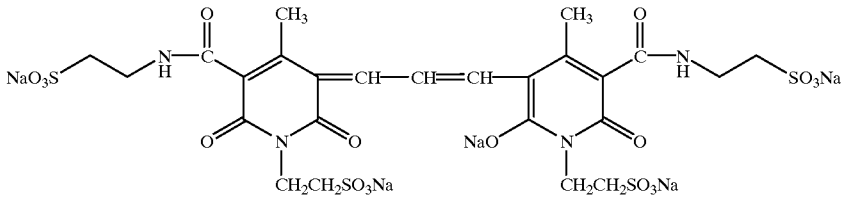
b-27
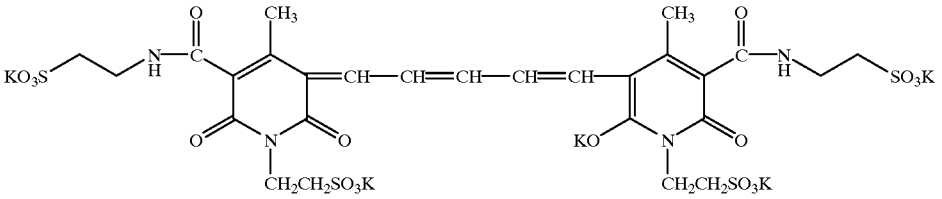

-continued
b-28
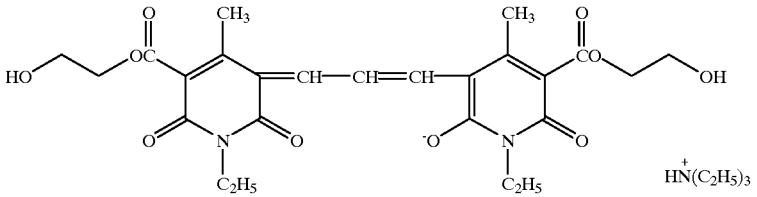
b-29
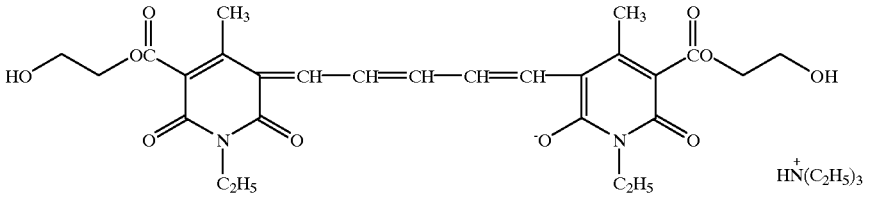
b-30
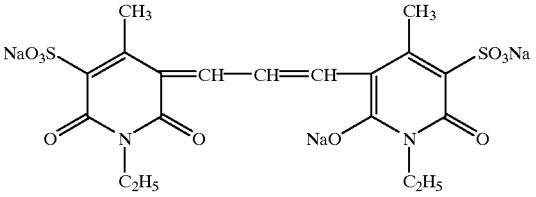
b-31
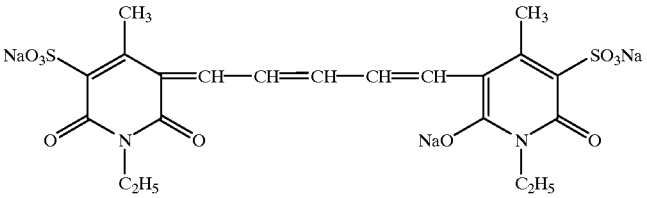
b-32
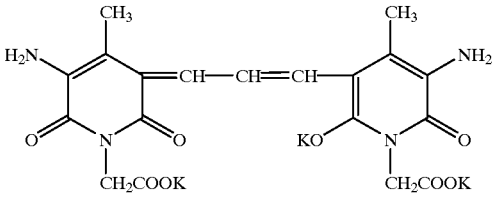
b-33
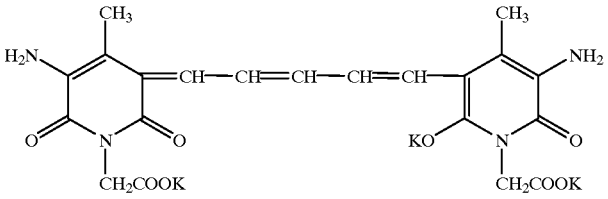
b-34
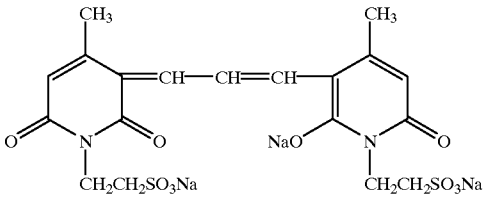

-continued
b-35
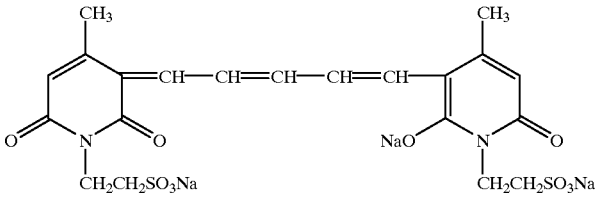
b-36
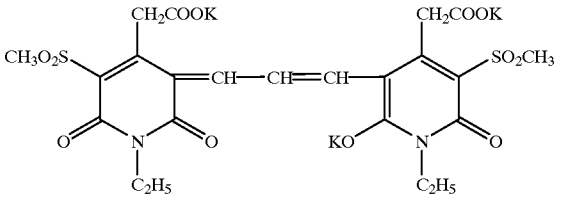
b-37
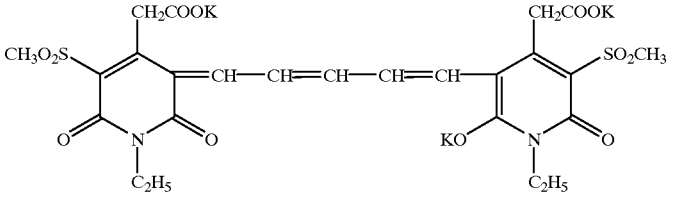
b-38
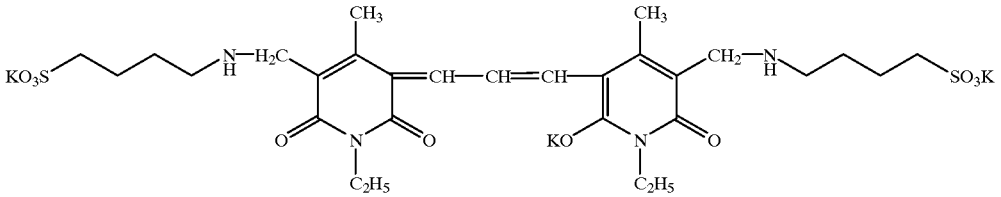
b-39
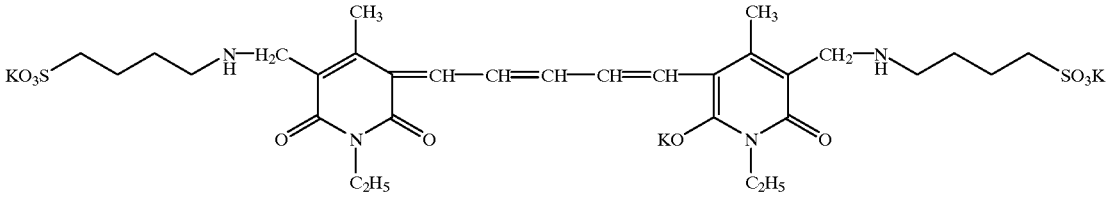
b-40
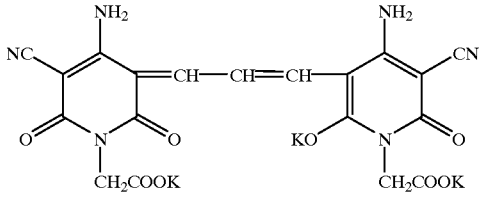
b-41
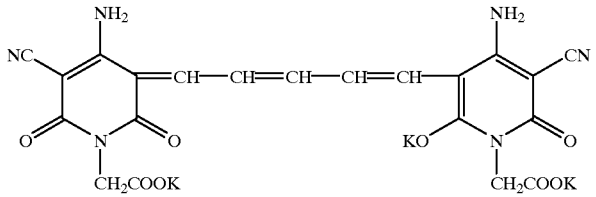

-continued
b-42
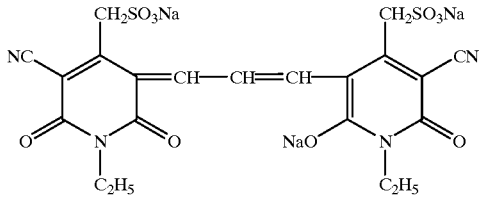
b-43
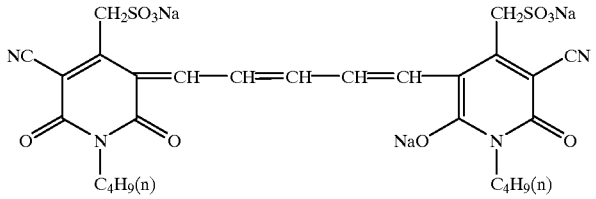
b-45
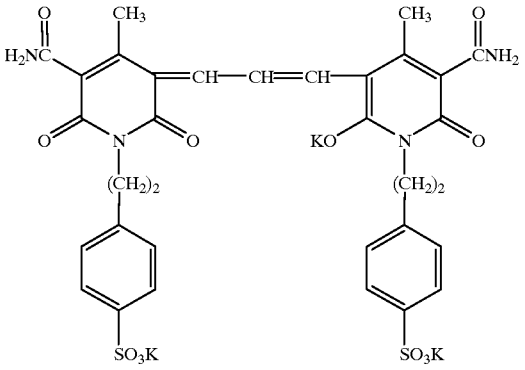
b-46
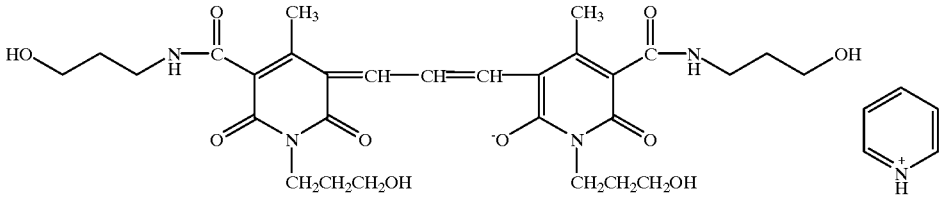
b-47
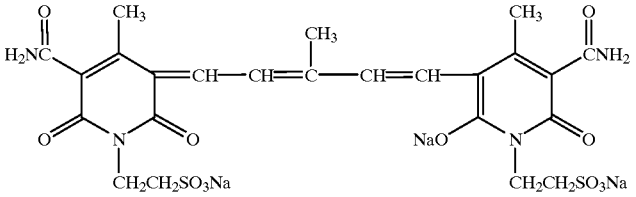
b-48
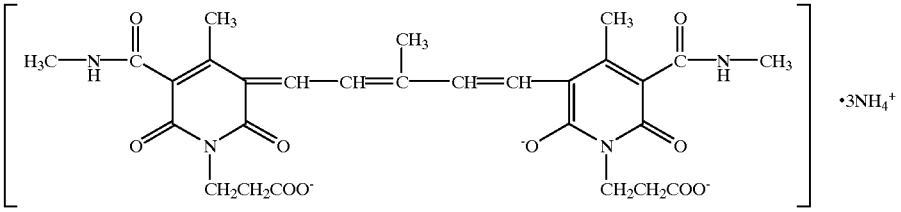

-continued
b-49
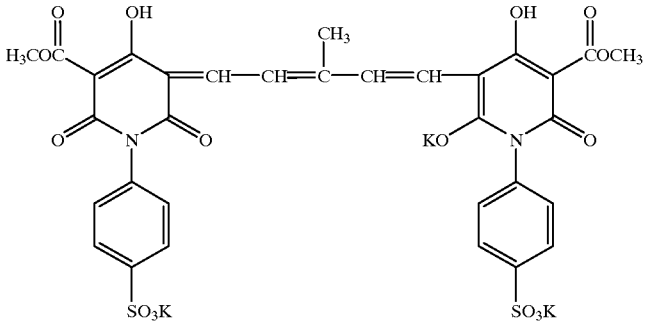
b-50
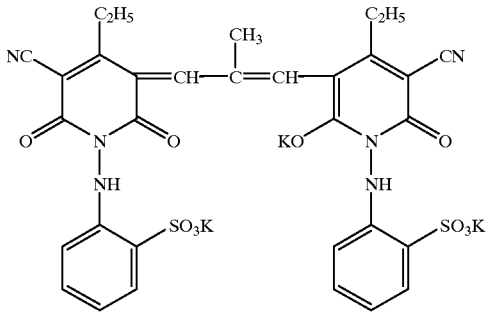
b-51
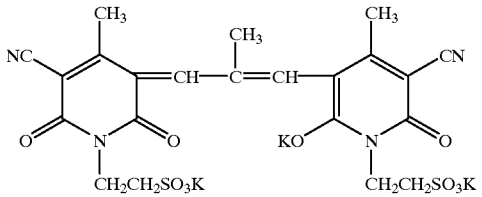
Exemplified compounds of formula I-c
c-1
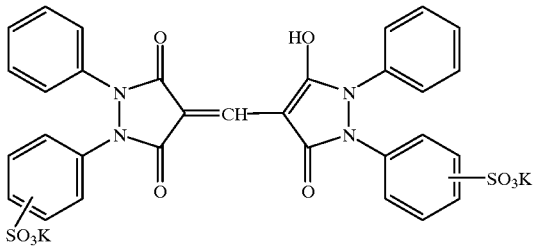
c-2
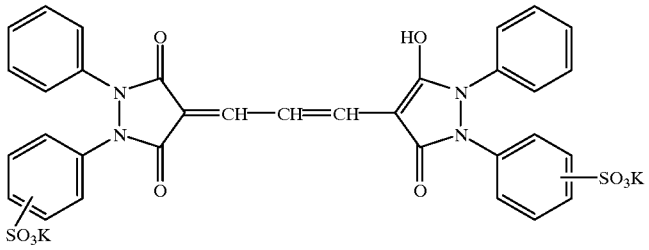

-continued
c-3
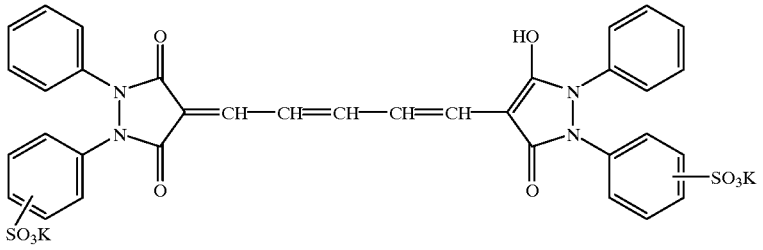
c-4
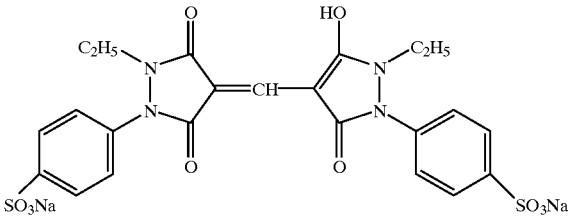
c-5
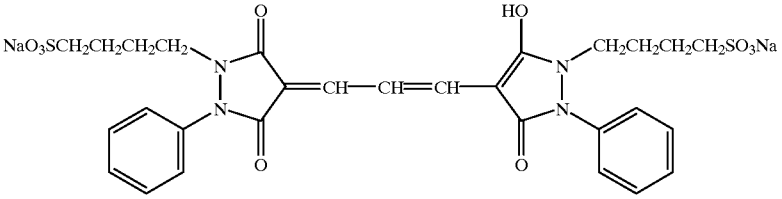
c-6
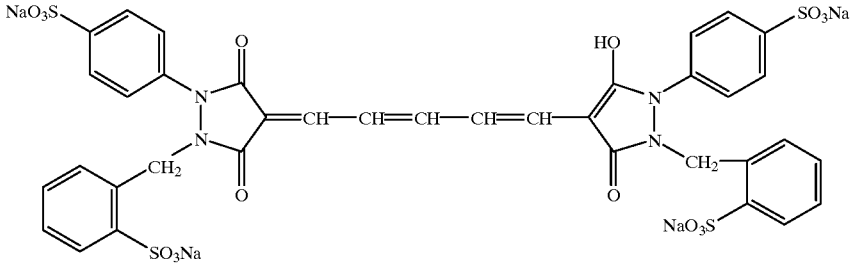
c-7
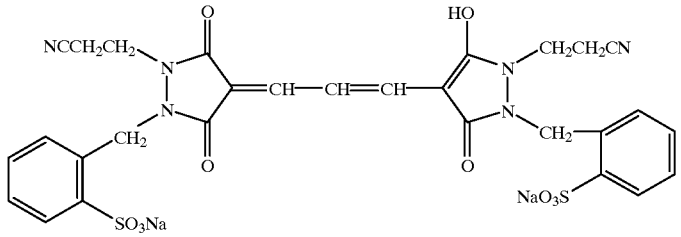
c-8
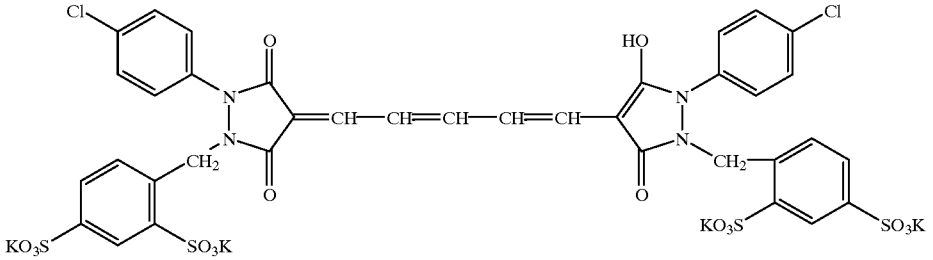

-continued
c-9
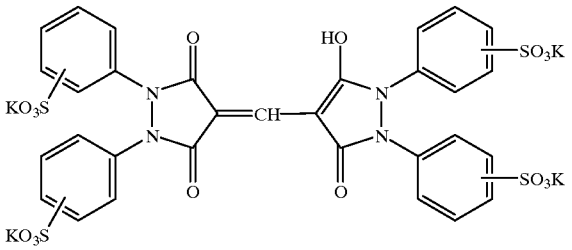
c-10
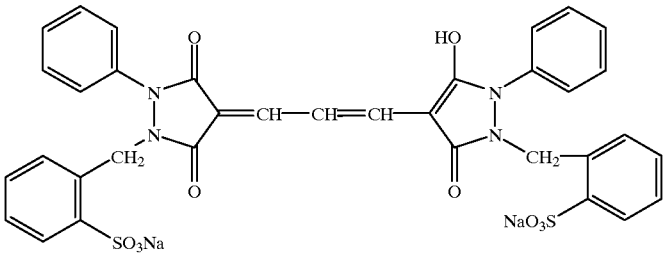
c-11
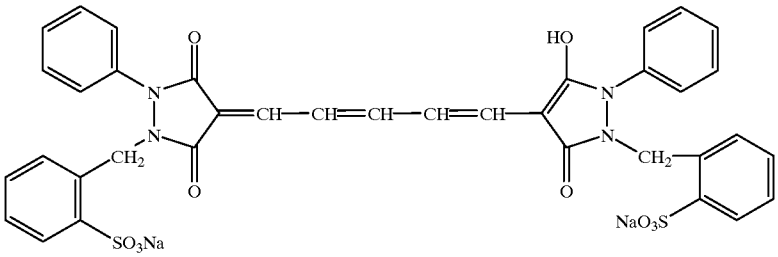
c-12
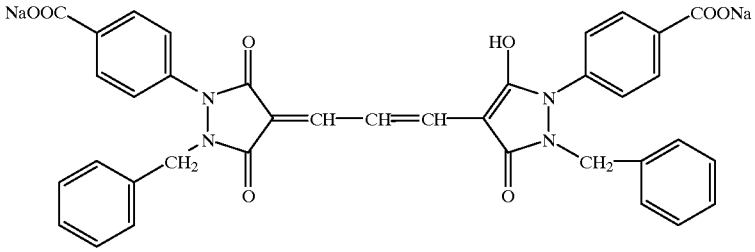
c-13
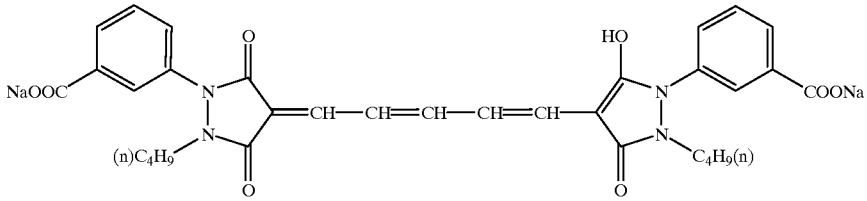
c-14
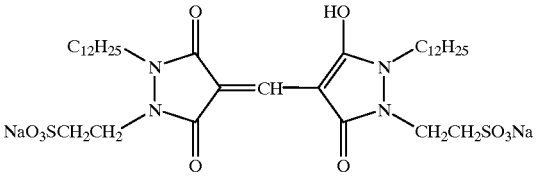

-continued
c-15
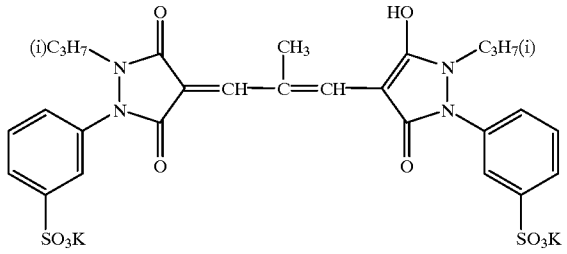
c-16
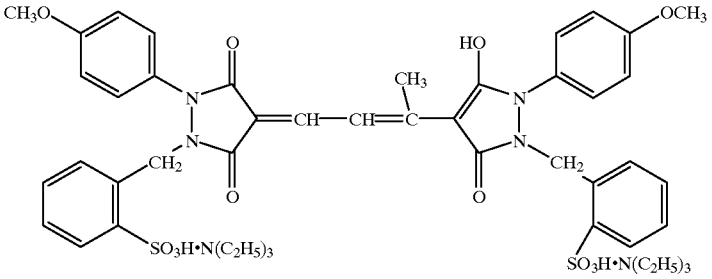
c-17
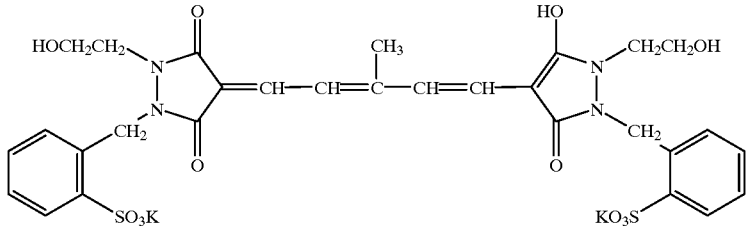
c-18
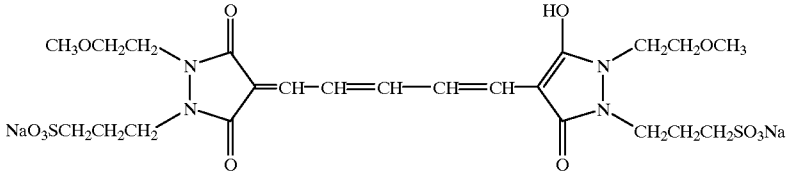
c-19
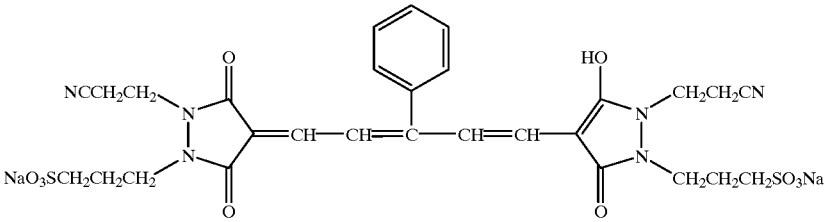
c-20
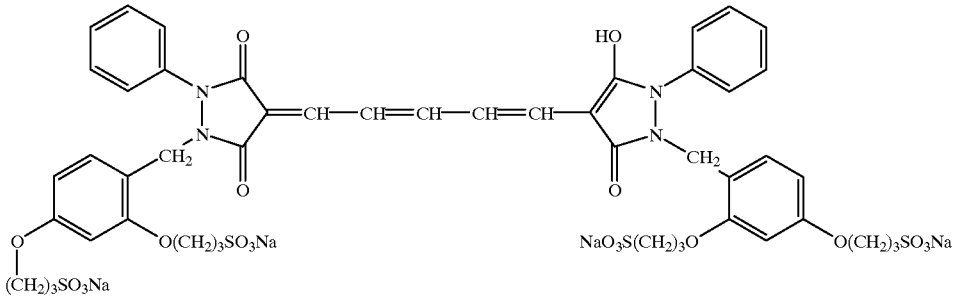

-continued
c-21
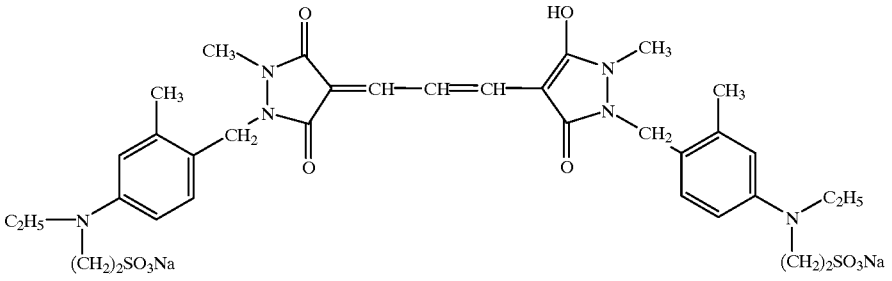
c-22
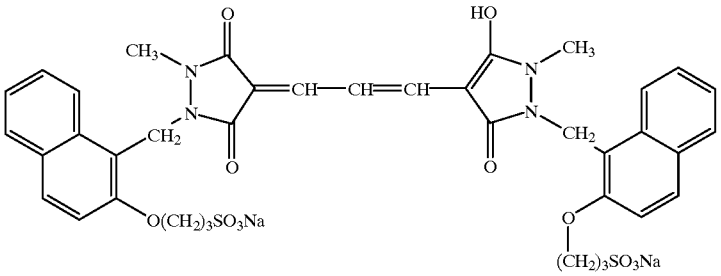
c-23
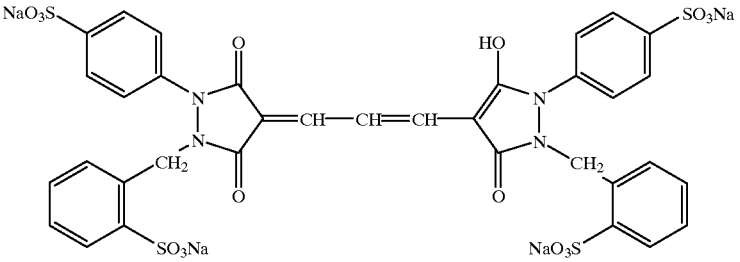
c-24
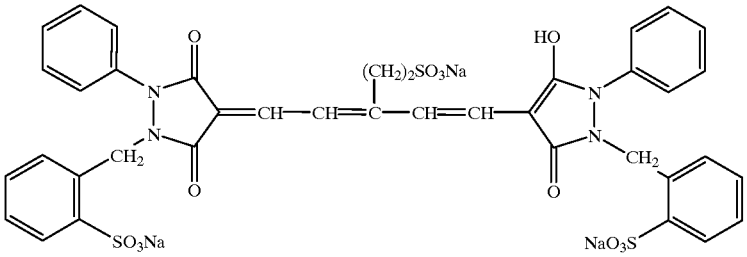
c-25
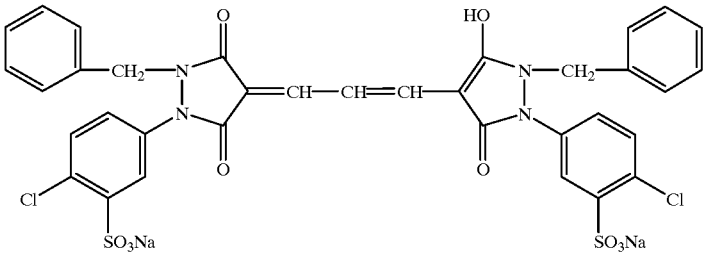

-continued
c-26
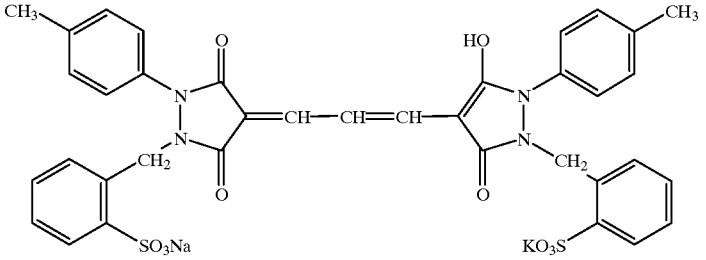
c-27
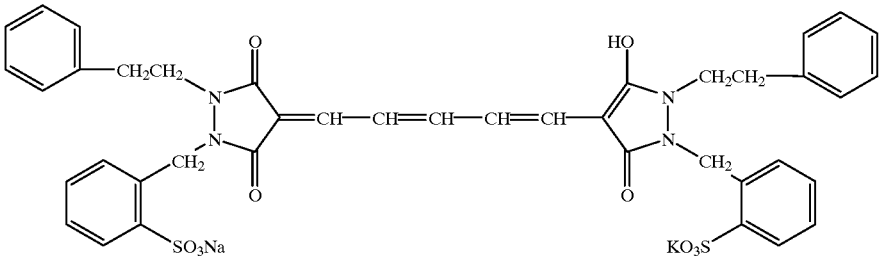
c-28
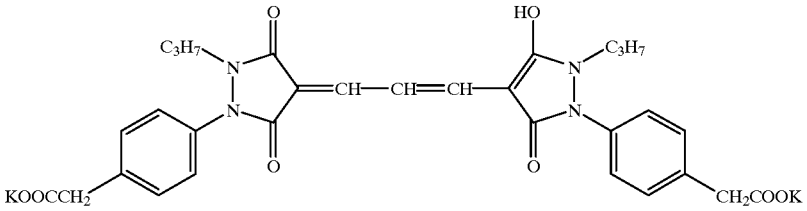
c-29
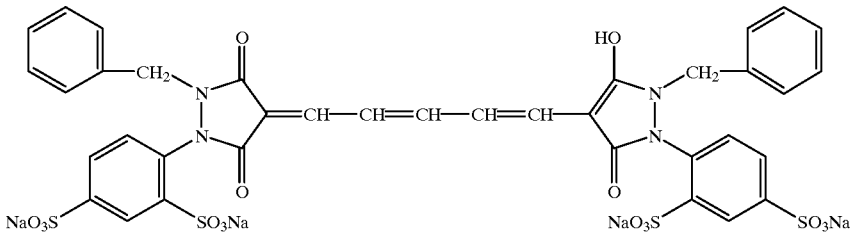
c-30
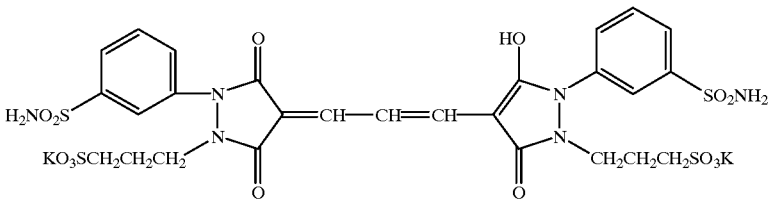
c-31
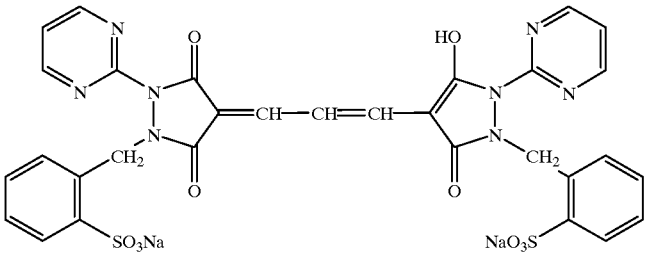

-continued
c-32
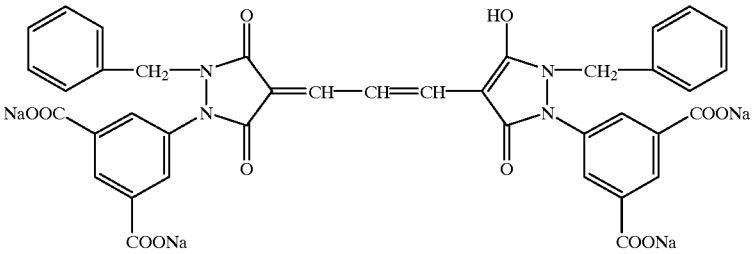
c-33
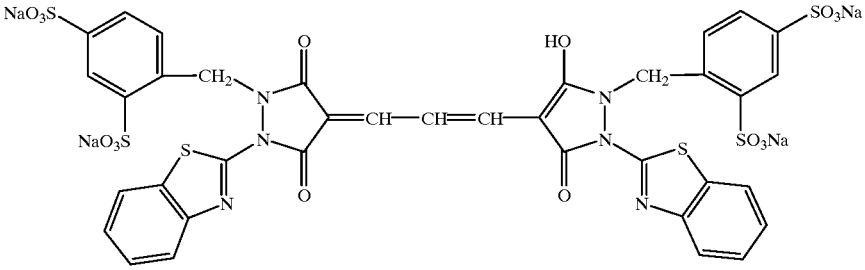
c-34
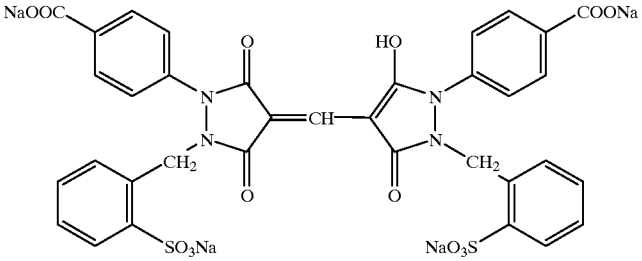
c-35
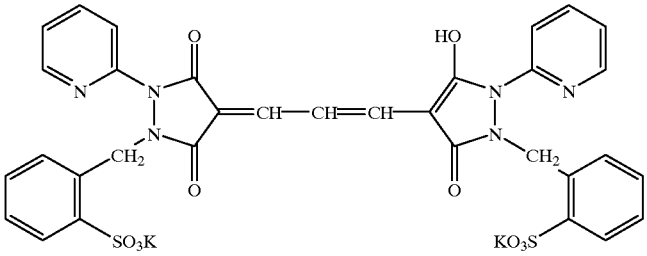
c-36
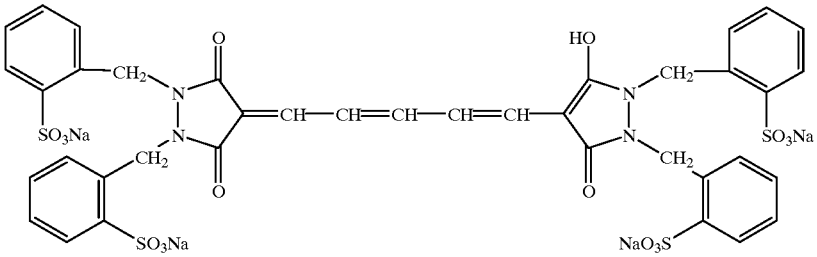
c-37
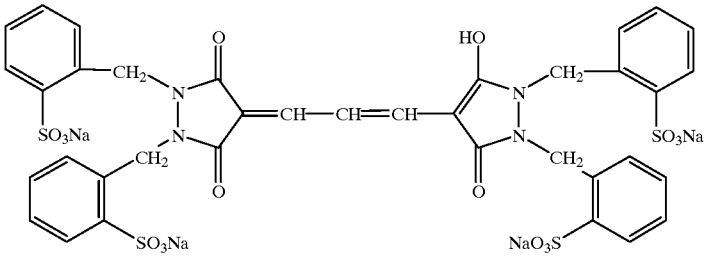

-continued
c-38
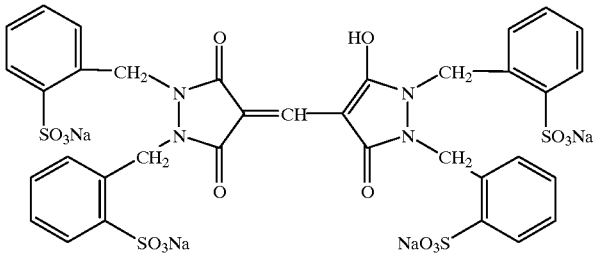
c-39
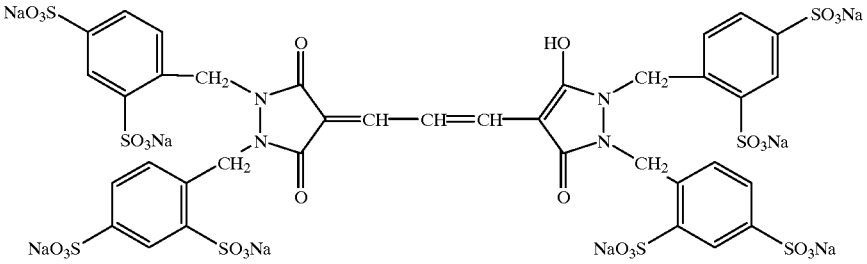
c-40
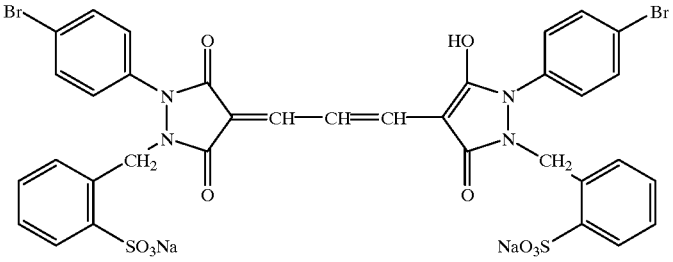
c-41
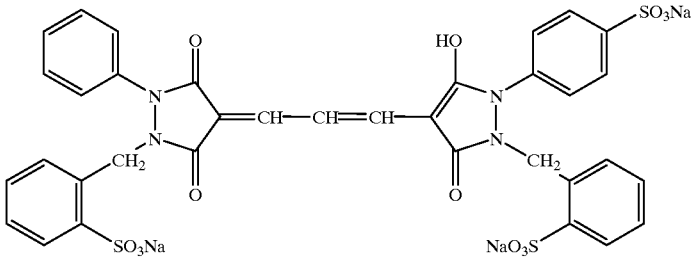
c-42
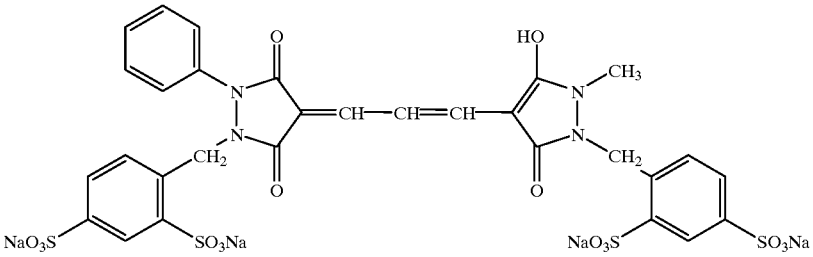
c-43
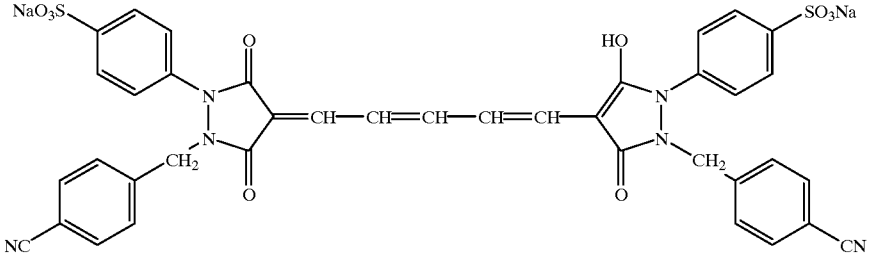

-continued
c-44
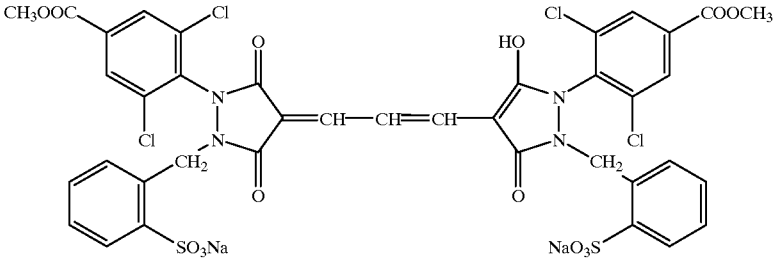
c-45
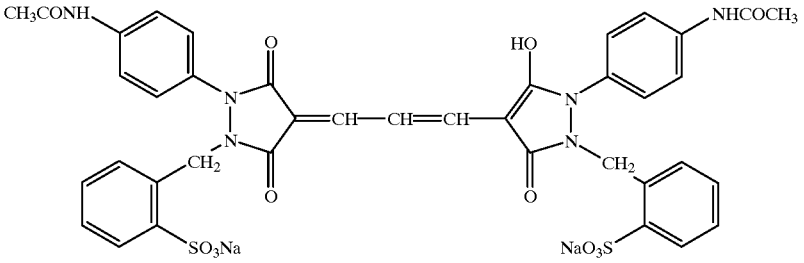
c-46
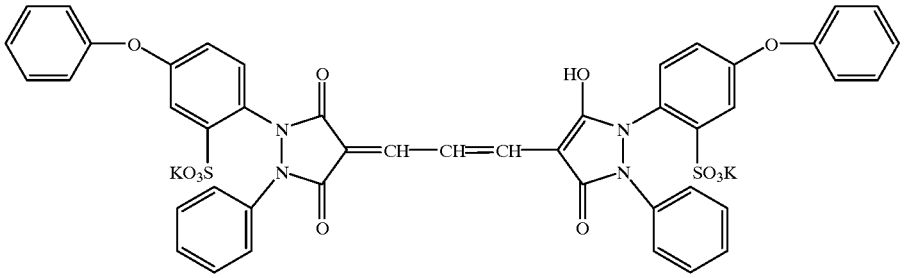
c-47
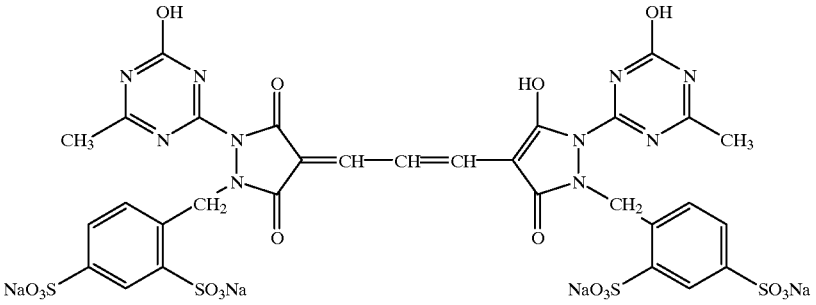
c-48
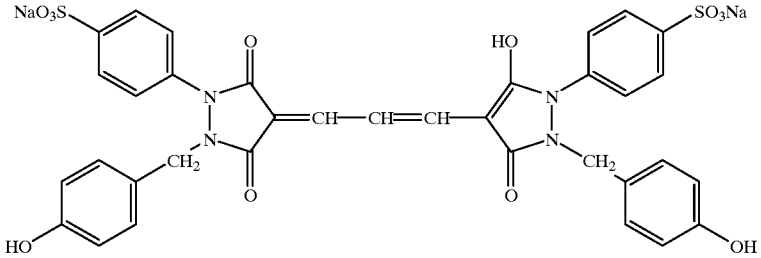

Exemplified compounds of formula I-d
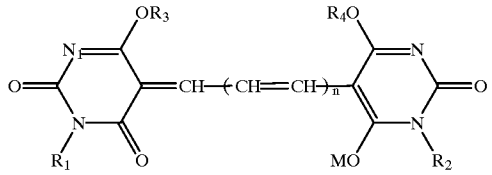
$R_1$, $R_2$, $R_3$, $R_4$, n and M are shown in the following Table.
| Compound No. | $R_1$ | $R_2$ | $R_3$ | $R_4$ | n | M |
|---|---|---|---|---|---|---|
| d-1 | 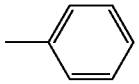 | —$C_{12}H_{25}$(n) | —H | —H | 0 | K |
| d-2 | 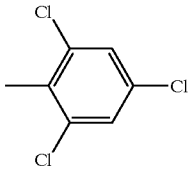 | —$C_{12}H_{25}$(n) | —H | —H | 0 | Na |
| d-3 | 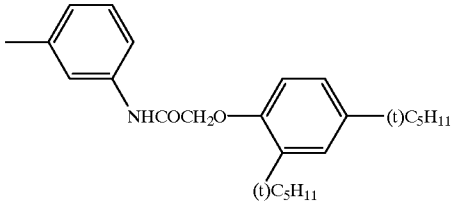 | —$CH_3$ | —$C_2H_5$ | —$C_2H_5$ | 1 | H |

-continued
Exemplified compounds of formula I-d
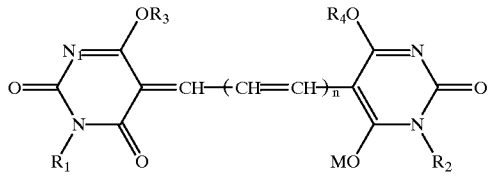
$R_1$, $R_2$, $R_3$, $R_4$, n and M are shown in the following Table.
| Compound No. | $R_1$ | $R_2$ | $R_3$ | $R_4$ | n | M |
|---|---|---|---|---|---|---|
| d-4 | 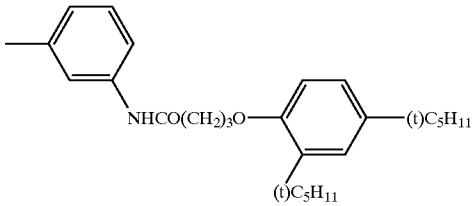 | 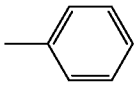 | —H | —H | 0 | H |
| d-5 | 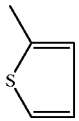 | 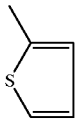 | 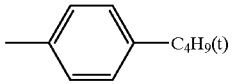 | 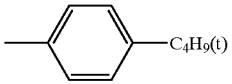 | 1 | H |
| d-6 | 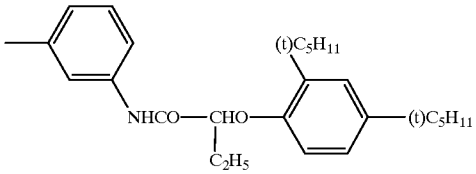 | 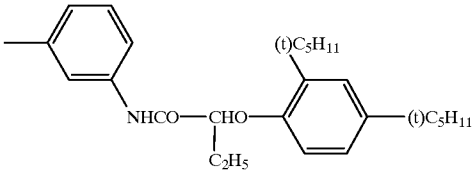 | —H | —H | 0 | H |
| d-7 | 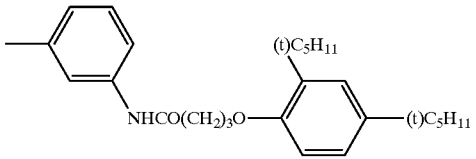 | 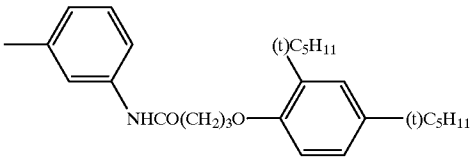 | $—CH_3$ | $—CH_3$ | 0 | H |

-continued
Exemplified compounds of formula I-d
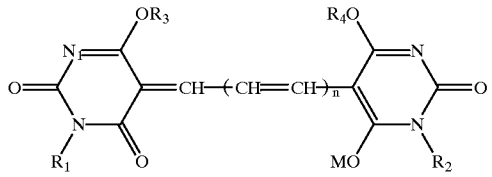
$R_1$, $R_2$, $R_3$, $R_4$, n and M are shown in the following Table.
| Compound No. | $R_1$ | $R_2$ | $R_3$ | $R_4$ | n | M |
|---|---|---|---|---|---|---|
| d-8 | 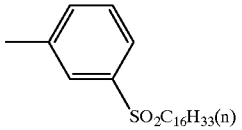 | 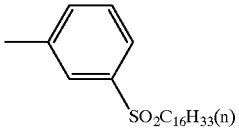 | $—CH_3$ | $—CH_3$ | 0 | Na |
| d-9 | 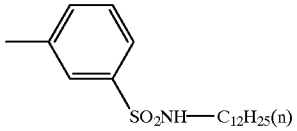 | 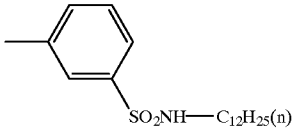 | $—C_4H_9$ | $—C_4H_9$ | 0 | Na |
| d-10 | 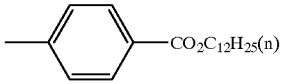 | 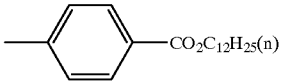 | —H | —H | 0 | H |
| d-11 | 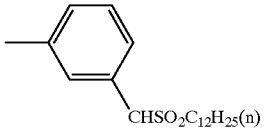 | 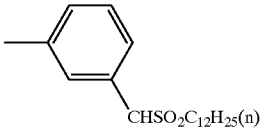 | 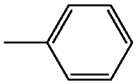 | 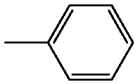 | 0 | K |

-continued
Exemplified compounds of formula I-d
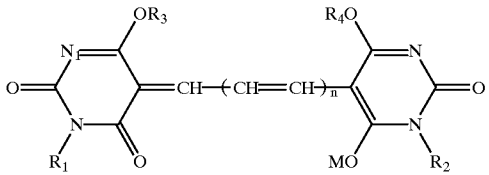
$R_1$, $R_2$, $R_3$, $R_4$, n and M are shown in the following Table.
| Compound No. | $R_1$ | $R_2$ | $R_3$ | $R_4$ | n | M |
|---|---|---|---|---|---|---|
| d-12 | 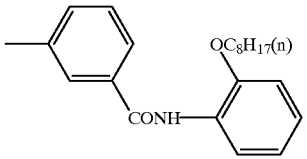 | 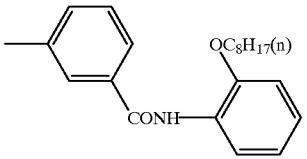 | 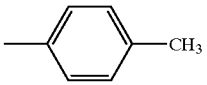 | 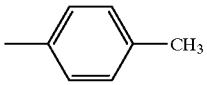 | 0 | H |
| d-13 | 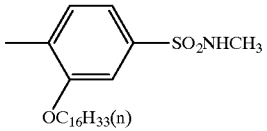 | 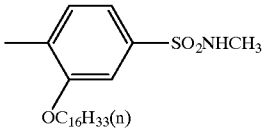 | —H | —H | 0 | H |
| d-14 | 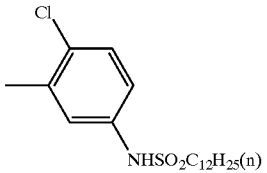 | 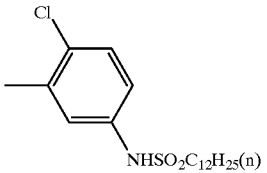 | —$CH_3$ | —$CH_3$ | 0 | H |
| d-15 | 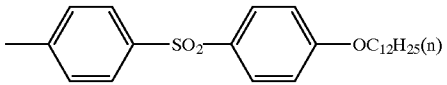 | 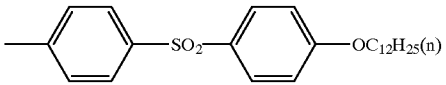 | —$C_2H_5$ | —$C_2H_5$ | 0 | H |

-continued
Exemplified compounds of formula I-d
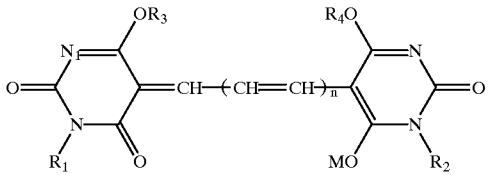
$R_1$, $R_2$, $R_3$, $R_4$, n and M are shown in the following Table.
| Compound No. | $R_1$ | $R_2$ | $R_3$ | $R_4$ | n | M |
|---|---|---|---|---|---|---|
| d-16 | 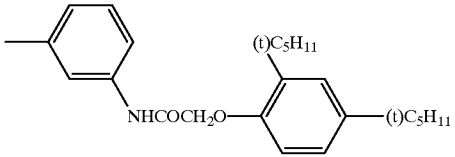 | 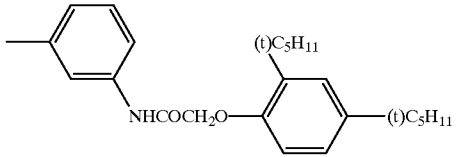 | $—C_2H_5$ | $—C_2H_5$ | 0 | H |
| d-17 | 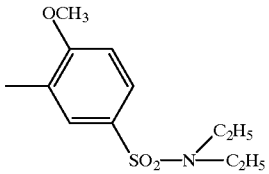 | 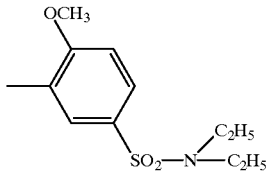 | $—C_8H_{17}(n)$ | $—C_8H_{17}(n)$ | 0 | H |
| d-18 | 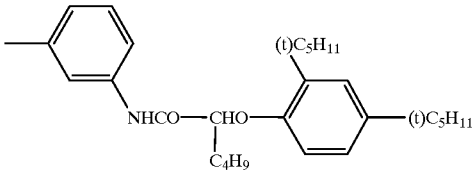 | 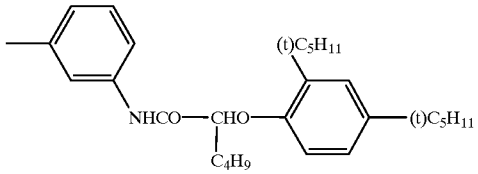 | —H | —H | 0 | Na |
| d-19 | 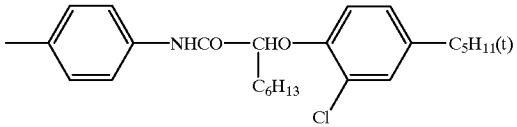 | 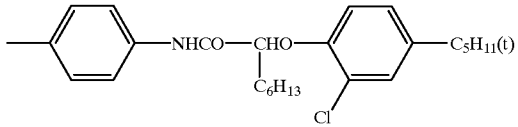 | —H | —H | 1 | H |

-continued
Exemplified compounds of formula I-d
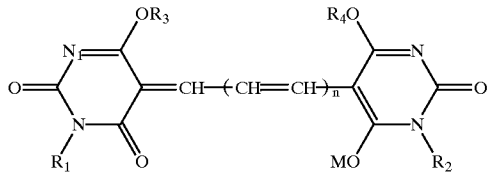
$R_1$, $R_2$, $R_3$, $R_4$, n and M are shown in the following Table.
| Compound No. | $R_1$ | $R_2$ | $R_3$ | $R_4$ | n | M |
|---|---|---|---|---|---|---|
| d-20 | 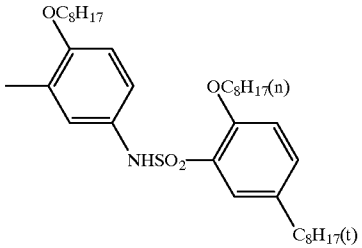 | 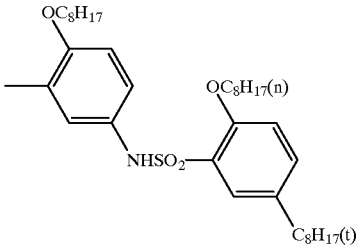 | —H | —H | 1 | K |
| d-21 | 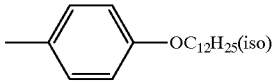 | 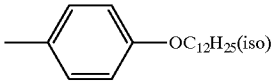 | $—C_2H_5$ | $—C_2H_5$ | 1 | H |
| d-22 | 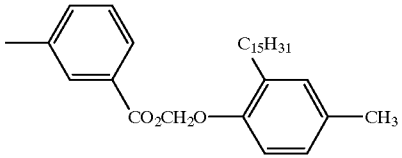 | 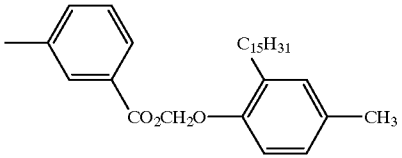 | —H | —H | 1 | H |
| d-23 | 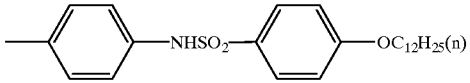 | 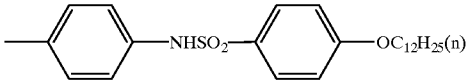 | —H | —H | 1 | H |

-continued
Exemplified compounds of formula I-d
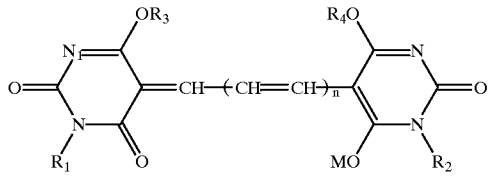
$R_1$, $R_2$, $R_3$, $R_4$, n and M are shown in the following Table.
| Compound No. | $R_1$ | $R_2$ | $R_3$ | $R_4$ | n | M |
|---|---|---|---|---|---|---|
| d-24 | 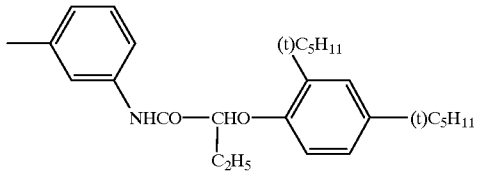 | 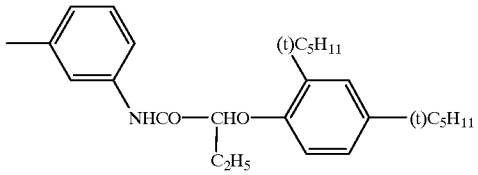 | —H | —H | 1 | H |
| d-25 | 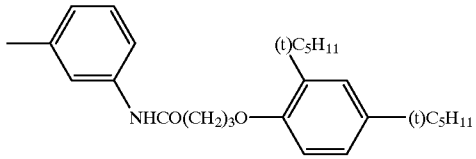 | 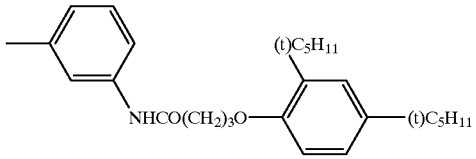 | $—CH_3$ | $—CH_3$ | 1 | H |
| d-26 | 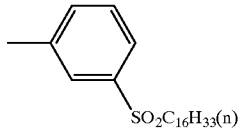 | 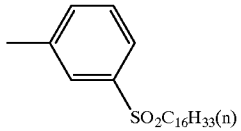 | $—CH_3$ | $—CH_3$ | 1 | H |
| d-27 | 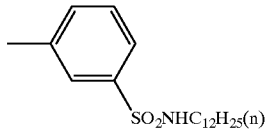 | 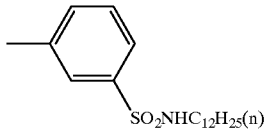 | $—C_4H_9$ | $—C_4H_9$ | 1 | Na |

-continued
Exemplified compounds of formula I-d
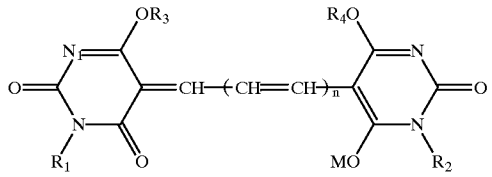
$R_1$, $R_2$, $R_3$, $R_4$, n and M are shown in the following Table.
| Compound No. | $R_1$ | $R_2$ | $R_3$ | $R_4$ | n | M |
|---|---|---|---|---|---|---|
| d-28 | 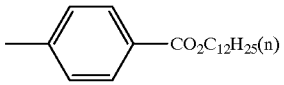 | 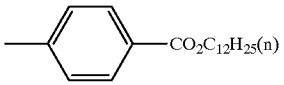 | —H | —H | 1 | H |
| d-29 | 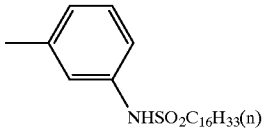 | 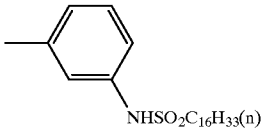 | 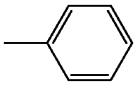 | 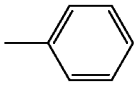 | 2 | K |
| d-30 | 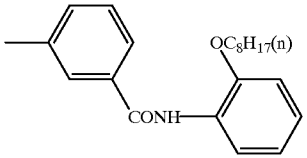 | 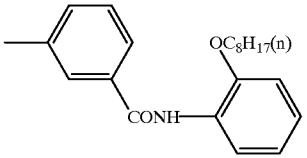 | 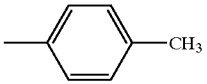 | 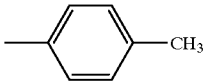 | 2 | H |
| d-31 | 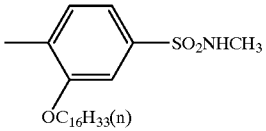 | 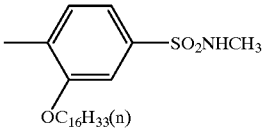 | —H | —H | 2 | H |

-continued
Exemplified compounds of formula I-d
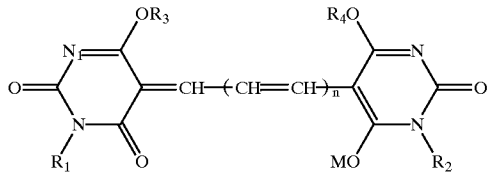
$R_1$, $R_2$, $R_3$, $R_4$, n and M are shown in the following Table.
| Compound No. | $R_1$ | $R_2$ | $R_3$ | $R_4$ | n | M |
|---|---|---|---|---|---|---|
| d-32 | 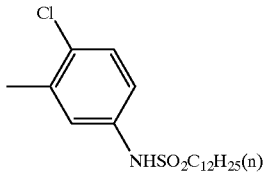 | 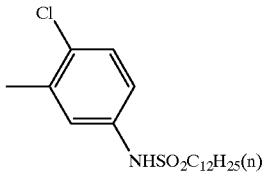 | $—CH_3$ | $—CH_3$ | 2 | H |
| d-33 | 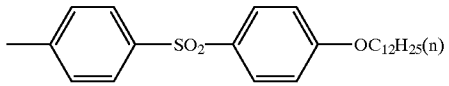 | 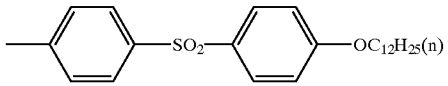 | $—C_2H_5$ | $—C_2H_5$ | 2 | H |
| d-34 | 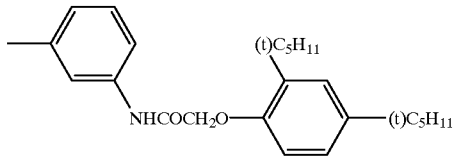 | 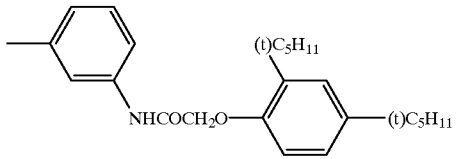 | $—C_2H_5$ | $—C_2H_5$ | 2 | H |
| d-35 | 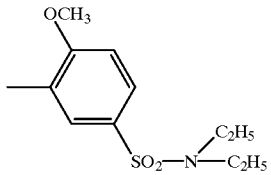 | 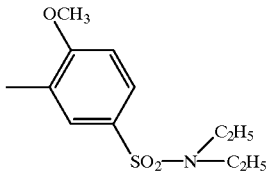 | $—C_8H_{17}(n)$ | $—C_8H_{17}(n)$ | 2 | Na |

-continued
Exemplified compounds of formula I-d
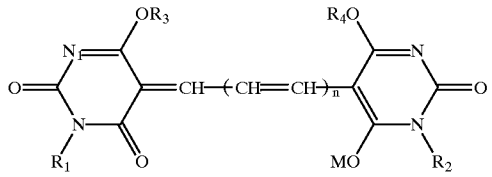
$R_1$, $R_2$, $R_3$, $R_4$, n and M are shown in the following Table.
| Compound No. | $R_1$ | $R_2$ | $R_3$ | $R_4$ | n | M |
|---|---|---|---|---|---|---|
| d-36 | 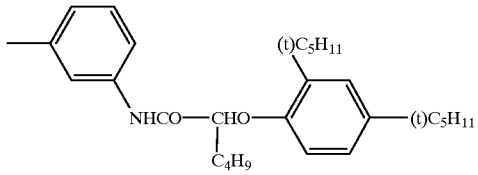 | 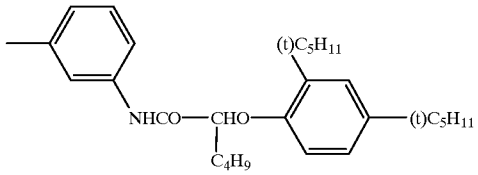 | —H | —H | 2 | Na |
| d-37 | 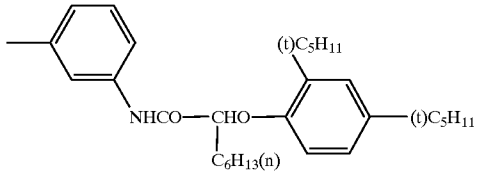 | 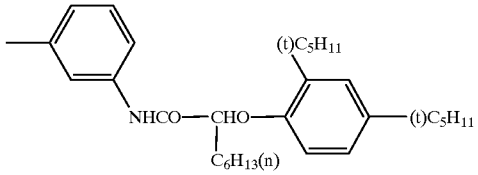 | —H | —H | 2 | Na |
| d-38 | 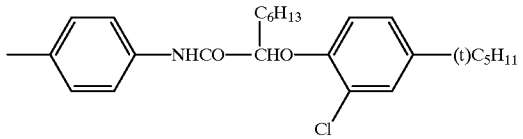 | 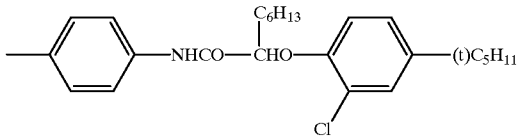 | —H | —H | 2 | K |

-continued
Exemplified compounds of formula I-d
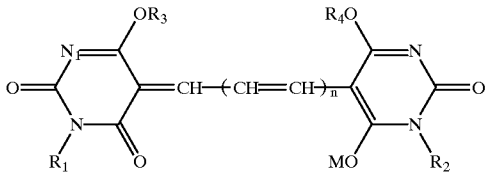
$R_1$, $R_2$, $R_3$, $R_4$, n and M are shown in the following Table.
| Compound No. | $R_1$ | $R_2$ | $R_3$ | $R_4$ | n | M |
|---|---|---|---|---|---|---|
| d-39 | 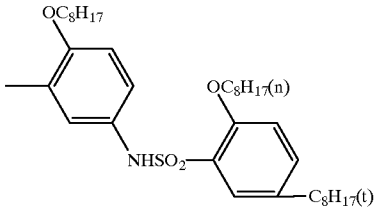 | 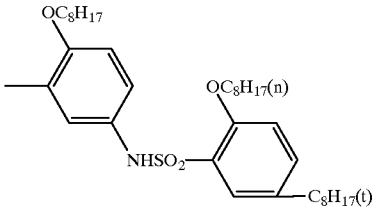 | —H | —H | 2 | K |
| d-40 | 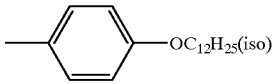 | 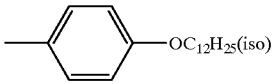 | $—C_2H_5$ | $—C_2H_5$ | 2 | Na |
| d-41 | 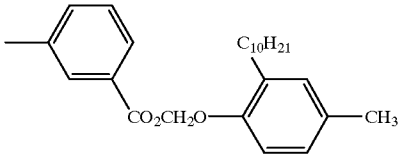 | 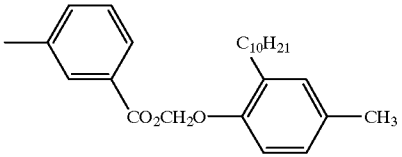 | —H | —H | 2 | Na |
| d-42 | 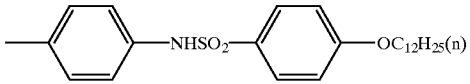 | 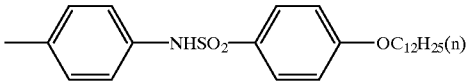 | —H | —H | 2 | H |
| d-43 | $—C_8H_{17}(n)$ | $—C_8H_{17}(n)$ | 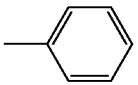 | 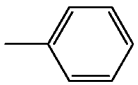 | 0 | K |

-continued
Exemplified compounds of formula I-d
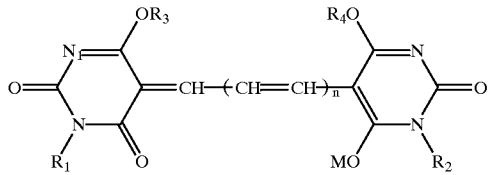
$R_1$, $R_2$, $R_3$, $R_4$, n and M are shown in the following Table.
| Compound No. | $R_1$ | $R_2$ | $R_3$ | $R_4$ | n | M |
|---|---|---|---|---|---|---|
| d-44 | $—CH_2—CH(C_2H_5)C_4H_9(n)$ | $—CH_2—CH(C_2H_5)C_4H_9(n)$ | $—C_8H_{17}(n)$ | $—C_8H_{17}(n)$ | 0 | H |
| d-45 | 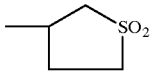 | 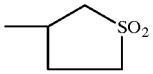 | $—C_2H_5$ | $—C_2H_5$ | 1 | Na |
| d-46 | $—C_{16}H_{33}(n)$ | $—C_{16}H_{33}(n)$ | —H | —H | 0 | H |
| d-47 | 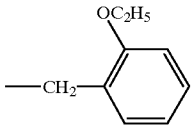 | 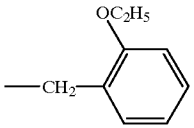 | $—C_4H_9(n)$ | $—C_4H_9(n)$ | 0 | K |

-continued
Exemplified compounds of formula I-d
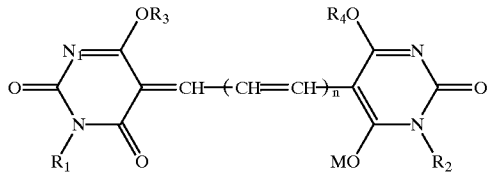
$R_1$, $R_2$, $R_3$, $R_4$, n and M are shown in the following Table.
| Compound No. | $R_1$ | $R_2$ | $R_3$ | $R_4$ | n | M |
|---|---|---|---|---|---|---|
| d-48 | 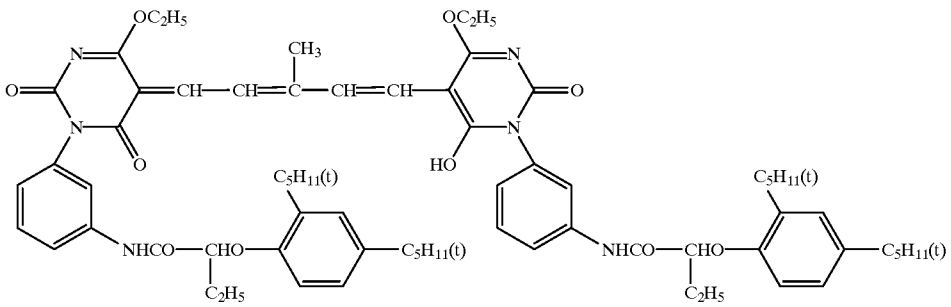 | | | | | |
| d-49 | 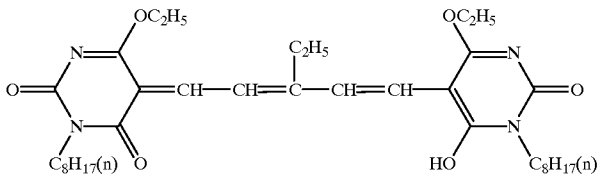 | | | | | |

Exemplified compounds of formula I-e
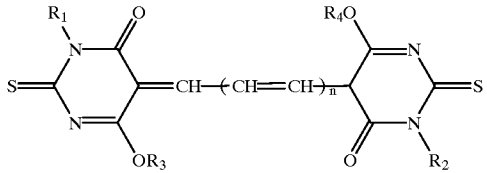
$R_1$, $R_2$, $R_3$, $R_4$, n and M are shown in the following Table.
| Compound No. | $R_1$ | $R_2$ | $R_3$ | $R_4$ | n | M |
|---|---|---|---|---|---|---|
| e-1 | 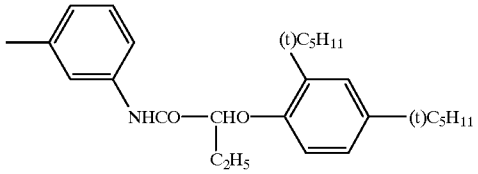 | 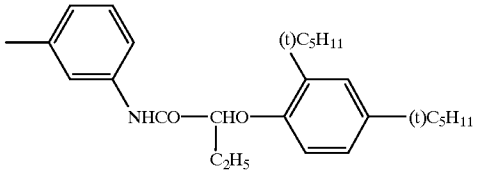 | $-C_2H_5$ | $-C_2H_5$ | 0 | H |
| e-2 | 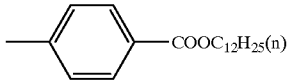 | 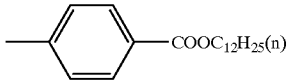 | $-C_4H_9$ | $-C_4H_9$ | 1 | H |
| e-3 | 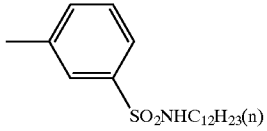 | 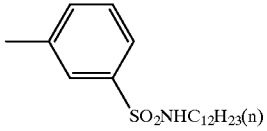 | $-C_2H_5$ | $-C_2H_5$ | 1 | H |
| e-4 | 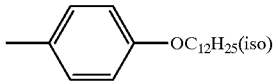 | 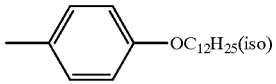 | $-CH_2CH=CH_2$ | $-CH_2CH=CH_2$ | 1 | H |

-continued
Exemplified compounds of formula I-e
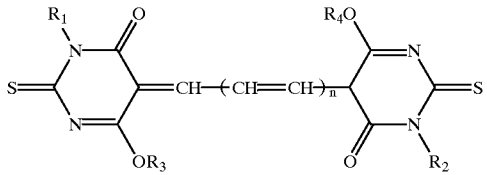
$R_1$, $R_2$, $R_3$, $R_4$, n and M are shown in the following Table.
| Compound No. | $R_1$ | $R_2$ | $R_3$ | $R_4$ | n | M |
|---|---|---|---|---|---|---|
| e-5 | 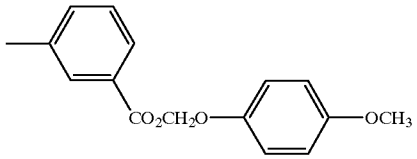 | 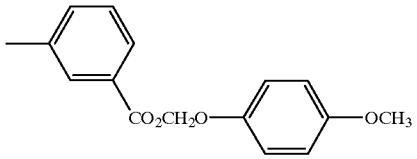 | $—C_2H_5$ | $—C_2H_5$ | 2 | H |
| e-6 | 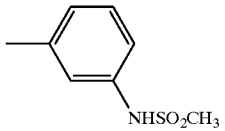 | 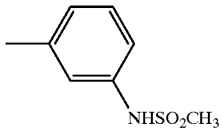 | $—C_3H_7$ | $—C_3H_7$ | 2 | H |

The compound in the invention represented by formula I can be prepared according to methods disclosed in U.S. Pat. No. 3,575,704, and Japanese Patent O.P.I. Publication Nos. 48-85130, 49-99620, 59-11164, 59-170838, 1-134447, 1-183652, and 4-46336.

The content of the compound in the invention in the ink receiving layer is preferably 0.01 to 10 mg/m$^2$, more preferably 0.03 to 8.0 mg/m$^2$, and still more preferably 0.1 to 4.0 mg/m$^2$. Two or more of the compound are preferably used in combination in the invention.

It has been proved that a color tone change due to light exposure at images with a lower density is reduced by localizing in the ink receiving layer the compound represented by formula (I) in the invention. For example, the compound represented by formula (I) in the invention is preferably localized at portions closer to the support in the ink receiving layer. Not less than 80 weight % of the compound represented by formula (I) in the invention are localized in the ink receiving layer, preferably within 50%, and more preferably within 30%, of the layer thickness, measured from the support. When two or more ink receiving layers are provided on the support, the compound of formula (I) is localized preferably in ink receiving layers other than the ink receiving layer furthest from the support, and more preferably in the ink receiving layer closest to the support.

The ink receiving layer in the invention preferably contains a water soluble polymer as a binder. The water soluble polymer herein referred to is a synthetic polymer, or a natural polymer or its derivatives, each being soluble in water. The water soluble polymer is preferably gelatin. As gelatin used in the invention, any gelatin made from animal collagen can be used, but gelatin made from pig skin, cow skin or cow bone collagen is preferable. The kind of gelatin is not specifically limited, but lime-processed gelatin, acid processed gelatin or gelatin derivatives (for example, gelatin derivatives disclosed in Japanese Patent Publication Nos. 38-4854/1962, 39-5514/1964, 40-12237/1965, 42-26345/1967 and 2-13595/1990, U.S. Pat. Nos. 2,525,753, 2,594,293, 2,614,928, 2,763,639, 3,118,766, 3,132,945, 3,186,846 and 3,312,553 and British Patent Nos. 861,414 and 103,189) can be used singly or in combination.

The gelatin derivative preferably used in the invention is those in which the amino, imino or carboxy group present in gelatin has a substituent, and preferably those in which the amino group present in gelatin has a substituent. The example of the gelatin derivative in which the amino group present in gelatin has a substituent includes phenylcarbamoylated gelatin.

In the invention, the gelatin derivative, in which the amino group present in gelatin has a substituent, includes those disclosed in U.S. Pat. Nos. 2,691,582, 2,614,928 and 2,525,753.

The above substituent includes the following group:

(a) alkylacyl, arylacyl, for example, acetyl, or substituted or unsubstituted benzoyl, (b) a sulfonyl group such as alkylsulfonyl or arylsulfonyl, (c) a carbamoyl group such as alkylcarbamoyl or arylcarbamoyl, (d) a thiocarbamoyl group such as alkylthiocarbamoyl or arylthiocarbamoyl, (e) a straight-chained or branched alkyl group having 1 to 18 carbon atoms, and (f) an aryl or heterocyclic group such as a substituted or unsubstituted phenyl or naphthyl, pyridyl or furyl.

The gelatin derivative in the invention preferably has an amino group having an acyl group (—COR$^1$) or a carbamoyl group (—CONR$^1$R$^2$), in which R$^1$ represents a substituted or unsubstituted aliphatic group (for example, an alkyl group having 1 to 18 carbon atoms, an aryl group or an aralkyl group (for example, phenetyl) and R$^2$ represents a hydrogen atom, an aliphatic group, an aryl or aralkyl group. In the invention, it is especially preferable that R$^1$ is an aryl group and R$^2$ is a hydrogen atom.

The example of the substituent in the amino group in the gelatin derivative is listed below, but is not limited thereto.

Example of the substituent in the amino group in the gelatin derivative:

(A-1)

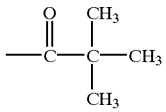

(A-2)

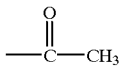

(A-3)

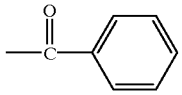

(A-4)

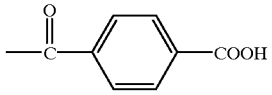

(A-5)

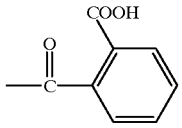

(A-6)

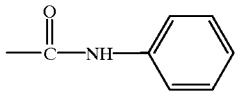

(A-7)

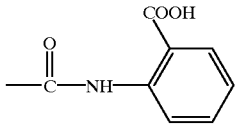

(A-8)

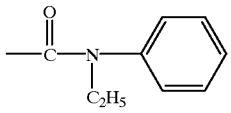

(A-9)

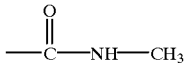

In order to quickly absorb ink in the ink receiving layer, a gelatin derivative, in which 60% or more, preferably 80% or more of one of the amino and imino group have a substituent, is preferably used.

The jelly strength of gelatin used in the invention is preferably not less than 150 kg, and more preferably 200 to 300 kg (according to the PAGI method). The jelly strength of gelatin is measured with a bloom gelometer.

The water soluble polymer other than gelatin preferably used includes polyvinyl alcohol, polyvinyl pyrrolidone, polyvinyl pyridinium halide, modified polyvinyl alcohol such as polyvinyl formal or their derivatives (see Japanese Patent O.P.I. Publication Nos. 145879/1985, 220750/1985, 143177/1986, 235182/1986, 235183/1986, 237681/1986 and 261089/1986), an acryl group-containing polymer such as polyacrylamide, polydimethylacrylamide, polydimethylaminoacrylate, or acrylic acid-vinyl alcohol copolymer (disclosed in Japanese Patent O.P.I. Publication Nos. 168651/1985 and 9988/1987), a natural polymer or its derivatives such as starch, oxidation starch, carboxylated starch, dialdehyde starch, cationated starch, dextrin, sodium alginate, gum arabic, casein, pullulan, dextrane, methylcellulose, ethylcellulose, carboxymethylcellulose or hydroxypropylcellulose (Japanese Patent O.P.I. Publication Nos. 174382/1974, 262685/1985, 143177/1986, 181679/1986, 193879/1986 and 287782/1986), a polyalkylene glycol such as polyethylene glycol or polypropylene glycol, a synthetic polymer such as polyvinyl ether, polyglycerin, maleic acid-alkylvinylether copolymer, maleic acid-N-vinylpyrrole copolymer, styrene-maleic anhydride copolymer or polyethylene imine (disclosed in Japanese Patent O.P.I. Publication Nos. 32787/1986, 237680/1986 and 277483/1986). In the invention, the ink receiving layer contains preferably two or more water soluble polymers other than gelatin, more preferably gelatin and the water soluble polymer other than gelatin, and most preferably gelatin and two or more water soluble polymers other than gelatin. Of the above water soluble polymers, the more preferable are polyvinyl pyrrolidones, polyvinyl alcohols or polyalkylene glycols.

The water soluble polymer content of the ink receiving layer in the invention is preferably 10 to 70 weight %, and more preferably 20 to 60 weight %.

The ink receiving layer can contain an anionic polyurethane with a glass transition temperature of 60° C. or more in view of glossiness at image portions.

The anionic polyurethane in the invention is an addition polymerization compound of a polyisocyanate compound with a polyol having two or more hydroxy groups, and is a urethane polymer having an anionic group in the main or side chain.

The anionic polyurethane used in the invention is preferably in the form of an aqueous dispersion in which an organic solvent is not used in coating in view of environmental concerns. There are two types of aqueous polyurethane dispersions, and one is a forced emulsifying dispersion in which polyurethane is emulsified by use of a surfactant and the other a self-emulsifying dispersion in which a hydrophilic group is incorporated in the polyurethane skeleton so that the polyurethane is emulsified. Both dispersions can be used in the present invention and the self-emulsifying dispersion is preferable in view of glossiness and transparency of a recording sheet for ink jet recording.

Of polyisocyanates for forming a polyurethane, the compound having two isocyanate groups includes 1,2-diisocyanateethane, 1,3-diisocyanatepropane, tetramethylenediisocyanate, pentamethylenediisocyanate, hexamethylenediisocyanate, nonamethylenediisocyanate, decamethylenediisocyanate, ω,ω'-dipropyletherdiisocyanate, cyclohexanone-1,4-diisocyanate, dicyclohexylmethane-4,4'-diisocyanate, hexahydrodiphenyl-4,4,-diisocyanate, hexadihydrodiphenylether-4,4,-diisocyanate, phenylene-1,4'-diisocyanate, toluylene-2,6-diisocyanate, toluylene-2,4-diisocyanate, 1-methoxybenzene-2,4-diisocyanate, 1-chlorophenylenediisocyanate, tetrachlorophenylenediisocyanate, metaxylenediisocyanate, paraxylenediisocyanate, diphenylmethane-4,4'-diisocyanate, diphenylsufide-4,4'-diisocyanate, diphenylsulfone-4,4,-diisocyanate, diphenylether-4,4,-diisocyanate, diphenylether-3,4,-diisocyanate, diphenylkeyone-4,4'-diisocyanate, naphthalene-1,4-diisocyanate, naphthalene-1,5-diisocyanate, 2,4'-biphenyldiisocyanate, 4,4,-biphenyldiisocyanate, 3,3'-dimethoxy-4,4,-biphenyldiisocyanate, anthraquinone-2,6-diisocyanate, triphenylmethane-4,4'-diisocyanate and azobenzene-4,4,-diisocyanate.

The compound having three isocyanate groups includes a compound represented by the following formula (I), (II), (III), or (IV):

(I)

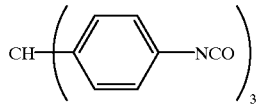

(II)

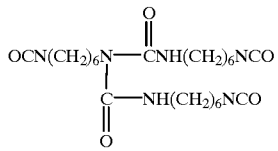

(III)

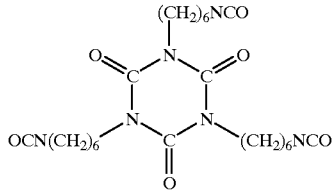

(IV)

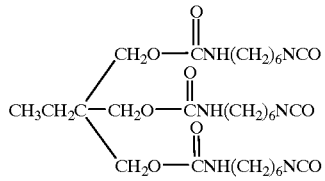

The polyol having two or more hydroxy groups includes a diol such as ethylene glycol, diethylene glycol, triethylene glycol or propylene glycol, a triol such as trimethylolethane, trimethylolpropane, hexanetriol or glycerin, a hexaol such as sorbitol, polyesterpolyol, polyetherpolyol and polyesterpolyetherpolyol. The polyesterpolyol is a compound prepared from a polybasic acid and a polyhydric compound and is preferably a compound having a hydroxy group in the end. As the polybasic acid, a saturated fatty acid such as oxalic acid, succinic acid, adipic acid or pimellic acid, an unsaturated fatty acid such as maleic acid or fumalic acid, an aromatic acid such as phthalic acid or isophthalic acid or their anhydride is used singly or in combination and as the polyhydric compound, a diol such as ethylene glycol, diethylene glycol, triethylene glycol or propylene glycol, a triol such as trimethylolpropane, trimethylolethane, hexanetriol or glycerin, a hexaol such as sorbitol, polyesterpolyol is used singly or in combination.

The polyetherpolyol in the invention is a compound having two or more hydroxy groups and an ether bond in the molecule. The polyetherpolyol includes a homopolymer or copolymer of ethylene oxide (EO) or propylene oxide (PO), a triol such as glycerin, trimethylolpropane or hexanetriol, a hexaol such as sorbitol, a polyol prepared by addition of EO or PO to amines such as ethylenediamine, benzensulfamide, 2-aminoethanolamine, N-methyldiethanolamine, diethylenetriamine and an amine having an aromatic group and their derivative. The polyetherpolyol can be used singly or in combination. The polyesterpolyetherpolyol is a polycondensate of the polybasic acid with the polyetherpolyol compound, the polycondensate having a hydroxy group in the end.

The other polyols include castor oil, tall oil or their derivative, acrylpolyol and urethanepolyol. These polyols can be used singly or in combination.

The polyurethane consisting of the above described components can be prepared by conventional methods. The polyurethane in the invention has a glass transition temperature of 60° C. or more, and preferably 70° C. or more. The glass transition temperature, at the temperature of which thermal expansion coefficient or specific heat of the polymer is discontinuously changed, can be measured in the process of heating the polymer according to a conventional method. The anionic polyurethane in the invention is preferably a self-emulsifying dispersion in which an anionic group is incorporated in the polyurethane skeleton and then emulsified. The typical example of the anionic group includes a carboxyl group, a sulfonic acid group, a sulfate ester group and a phosphate ester group.

A layer provided on one or each side of the support may contain a matting agent in an amount of 0.005 to 0.1 g/m$^2$ in order to minimize adhesion failure such as blocking.

The matting agent can be defined as discontinuously dispersed particles such as inorganic or organic materials capable of being dispersed in a hydrophilic organic colloid. The inorganic matting agent includes oxides such as silicon oxide, titanium oxide, magnesium oxide and aluminum oxide, alkali earth metal salts such as barium sulfate, calcium carbonate, and magnesium sulfate, light-insensitive silver halide particles such as silver chloride and silver bromide (each of which may contain a small amount of an iodine atom), and glass.

Besides these substances are used inorganic matting agents which are disclosed in West German Patent No. 2,529,321, British Patent Nos. 760 775 and 1,260,772, U.S. Pat. Nos. 1,201,905, 2,192,241, 3,053,662, 3,062,649, 3,257,296, 3,322.555, 3,353,958, 3,370,951, 3,411,907, 3,437,484, 3,523,022, 3,615,554, 3,635,714, 3,769,020, 4,021,245 and 4,029,504.

The organic matting agent includes starch, cellulose ester such as cellulose acetate propionate, cellulose ether such as ethyl cellulose and a synthetic resin. The synthetic resin is a water insoluble or sparingly soluble polymer which includes a polymer of an alkyl(meth)acrylate, an alkoxyalkyl-(meth) acrylate, a glycidyl(meth)acrylate, a (meth)acrylamide, a vinyl ester such as vinyl acetate, acrylonitrile, an olefin such as ethylene, or styrene and a copolymer of the above described monomer with other monomers such as acrylic acid, methacrylic acid, α,β-unsaturated dicarboxylic acid, hydroxyalkyl(meth)acrylate, sulfoalkyl(meth)acrylate and styrene sulfonic acid.

Further, an epoxy resin, nylon, polycarbonates, phenol resins, polyvinyl carbazol or polyvinylidene chloride can be used. Besides the above are used inorganic matting agents which are disclosed in British Patent No. 1,055,713, U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344,554, 3,591,379, 3,754,924 and 3,767,448, Japanese Patent O.P.I. Publication Nos. 49-106821/1974 and 57-14835/1982.

Of these are preferable polymethylmethacrylate, a benzoguanamine-formaldehyde polycondensate (a benzoguanamine resin as represented by the following formula, for example, Eposter produced by Nihon Shokubai Kagakukogyo Co., Ltd., or (Chemical Substance Registry No. 7-31 compound),

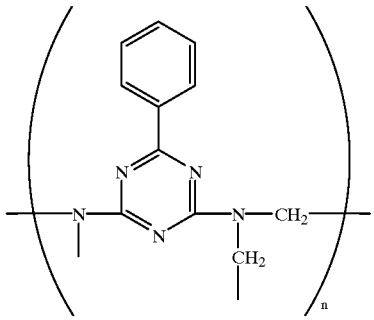

polyolefins (for example, Frobeads LE-1080, CL-2080, HE-5023: produced by Seitetsu Kagaku Co., Ltd., or Chemipar V-100 produced by Mitsuisekiyu Kagakukogyo Co., Ltd.), polystyrene beads (produced by Moritex Co., Ltd.), nylon beads (produced by Moritex Co., Ltd.), AS resin beads (produced by Moritex Co., Ltd.), epoxy resin beads (produced by Moritex Co., Ltd.) or polycarbonate resins (produced by Moritex Co., Ltd.).

These matting agents may be used in combination.

The ink receiving layer in the invention preferably contains a surfactant in order to improve dot for dot reproduction. The surfactant includes an anionic, cationic, nonionic or betaine type surfactant, which may be low or high molecular weight. The surfactant content of the ink receiving layer is preferably 0.001 to 5 g, and more preferably 0.10 to 3 g per 100 g of binder. In the invention, the ink receiving layer preferably contains a fluorine-containing surfactant. In two or more ink receiving layers, the outermost ink receiving layer preferably contains the fluorine-containing surfactant. The fluorine-containing surfactant is preferably anionic or cationic.

As an anionic fluorine-containing surfactant preferably used in the present invention, those represented by the following formula (FA) are cited.

$$(Cf)—(Y)_n \qquad \text{formula (FA)}$$

wherein Cf represents an n-valent group containing at least 3 fluorine atoms and at least 2 carbon atoms; Y represents a —COOM, —$SO_3$M, —$OSO_3$M or —P(=O)$(OM)_2$; M represents a hydrogen atom, an alkali metal or a cationic group such as a quaternary ammonium salt; and n represents 1 or 2.

The example of Cf includes an alkyl or alkenyl group having 2–30 carbon atoms and an aryl group, each containing at least 3 fluorine atoms.

As an anionic fluorine-containing surfactant preferably used in the present invention, those represented by the following formula (FA') are cited.

$$Rf—(D)_t—Y \qquad \text{formula (FA')}$$

wherein Rf represents a fluorine-containing alkyl group of 3–30 carbon atoms or an aryl group having a fluorine-containing alkyl group of 3–30 carbon atoms; D represents a divalent group having at least one of —O—, —COO—, —CON($R_1$)— and —$SO_2$N($R_1$)— bond and having 1 to 12 carbon atoms; $R_1$ represents an alkyl group having 1 to 5 carbon atoms; t represents 0, 1 or 2; Y represents —COOM, —$SO_3$M, —$OSO_3$M or —P(=O)$(OM)_2$; and M represents a hydrogen atom, an alkali metal or a cationic group such as a quaternary ammonium salt.

Next, examples of the compounds represented by formula (FA) will be illustrated. However, the present invention is not limited thereto.

FA-1

$C_7F_{15}COONH_4$

FA-2

$C_{10}F_{21}(CH_2)_{10}COOH$

FA-3

$C_8F_{17}SO_2-N(C_3H_7)-CH_2CH_2O(OCH_2)_3SO_3Na$

FA-4

$CF_3-C(C_2H_5)(C_2H_5)-CH(CF_3)-CF(CF_2Cl)-COONa$

FA-5

$ClCF_2-(CFCl-CF_2)_4-COOH$

FA-6

$H(CF_2)_{10}COOH$

FA-7

$HOOC(CF_2-CF(Cl))_4COOH$

FA-8

$Cl(CF_2-CF(Cl))_3CF_2COOK$

FA-9

$C_5F_{11}CH=CH(CH_2)_3COONa$

FA-10

$C_4F_9-CF(CF_3)(CH_2)_{10}COONa$

FA-11

$C_4F_9CO-N(CH_3)CH_2CH_2COOH$

FA-12

$Cl(CF_2)_6COONa$

FA-13

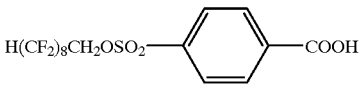

FA-14

$C_{10}F_{21}CH_2CH_2SO_2-N(C_2H_5)CH_2COONa$

FA-15

$C_6F_{13}CO-N(C_2H_5)CH_2COONa$

FA-16

$C_8F_{17}SO_2-N(C_3H_7)CH_2CH_2SO_3Na$

FA-17

$C_8F_{17}CO-N(C_2H_5)CH_2CH_2SO_3Na$

FA-18

$C_8F_{17}SO_2-N(C_2H_5)CH_2COONa$

-continued

FA-19

$C_8F_{17}SO_2-N(C_3H_7)CH_2COOK$

FA-20

$C_8F_{17}SO_2-N(CH_3)(CH_2CH_2O)_4(CH_2)_4SO_3Na$

FA-21

$CF_3-C(C_2F_5)(C_2F_5)-C(CF_3)(SO_3Na)-CHFCF_3$

FA-22

$NaO_3S-CH(CH_2COOCH_2CH_2-N(C_3H_7)SO_2C_8F_{17})COOCH_2CH_2-N(C_3H_7)SO_2C_8F_{17}$

FA-23

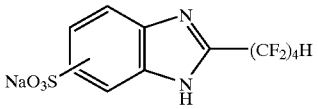

wherein —SO3Na is a 5- or 6-positioned or mixture thereof

FA-24

$H(CF_2)_6CH_2PO_3H_2$

FA-25

$H(CF_2)_8PO_3Na_2$

FA-26

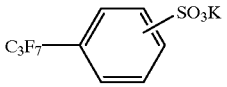

wherein —SO3K is a -o, -m, or -p-positioned or mixture thereof

FA-27

$C_8F_{17}SO_2-N(C_2H_5)(CH_2)_6COOK$

FA-28

$C_{12}F_{25}CH_2OSO_3Na$

FA-29

$C_7F_{15}COO(CH_2)_3SO_3K$

FA-30

$NaO_3S-CH(CH_2COOCH_2(CF_2)_6H)COOCH_2(CF_2)_6H$

FA-31

$C_{16}H_{33}-CH(SO_3Na)COOCH_2CF_3$

FA-32

$(CF_3)_2CFO(CF_2)_2CH_2-CH(CH_2)_6COONa$ $(CF_3)_2CFO(CF_2)_2CH_2-CH(CH_2)_6COONa$

FA-33

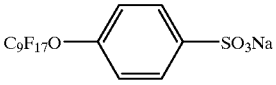

FA-34

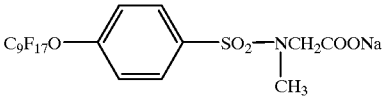

-continued

FA-35

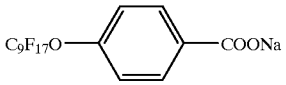

FA-36

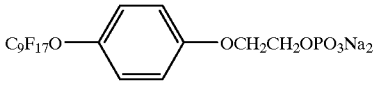

FA-37

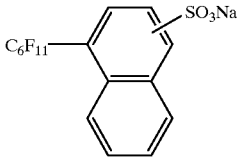

FA-38

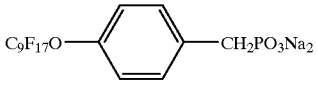

FA-39

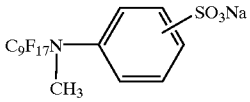

FA-40

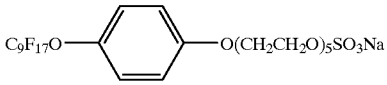

FA-41

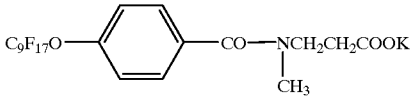

FA-42

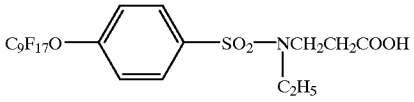

FA-43

$C_9F_{17}OCH_2CH_2OSO_3Na$

FA-44

$C_9F_{17}O(CH_2)_4OPO_3Na_2$

FA-45

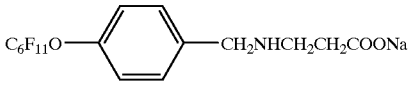

FA-46

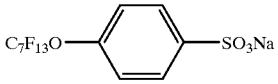

FA-47

$H(CF_2)_7O(CH_2)_3SO_3Na$

FA-48

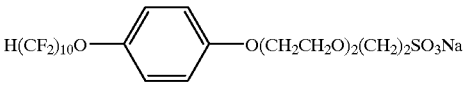

FA-49

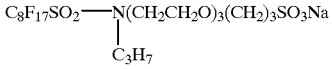

Specifically preferable are anionic fluorine-containing surfactants containing at least one —$SO_2N(R_1)$— bond.

Cationic fluorine-containing surfactants used in the present invention are compounds represented by the following formula (FK):

$$Rf'—L—X^+Z— \qquad \text{formula (FK)}$$

wherein Rf' represents a hydrocarbon group having 1 to 20 carbon atoms in which at least one hydrogen atom is substituted by a fluorine atom; L represents a chemical bond or a divalent group; X represents a cationic group; and Z represents a counter anion.

As examples of Rf', —$C_mF_{2m+1}$, and —$C_mF_{2m-1}$ (m=2 through 20, specifically 3 through 12 are preferable) are cited.

As examples of L, —$SO_2N(R_1)(CH_2)_p$—, —$CON(R_1)(CH_2)_p$—, —$OArSO_2N(R_1)(CH_2)_p$—, —$OArCON(R_1)(CH_2)_p$—, —$OArO(CH_2)_p$—, —$OAr(CH_2)_p$—, —$O(CH_2CH_2O)_q(CH_2)_p$—, —$O(CH_2)_p$—, —$N(R_1)(CH_2)_p$—, —$SO_2N(R_1)(CH_2)_pO(CH_2)_r$—, —$CON(R_1)(CH_2)_pO(CH_2)_r$—, —$OArSO_2N(R_1)(CHR_1)_pOAr$— and —$(CH_2)_p(CHOH)_s(CH_2)_r$—, are cited in which Ar represents arylene; $R_1$ represents a hydrogen atom or an alkyl group with 1 to 6 carbon atoms, which may have a substituent; p, r and s independently represent an integer of 0 to 6; and q represents an integer of 1 to 20.

As examples of $X^+$, —$N^+(R_1)_3$, —$N^+(CH_2CH_2OCH_3)_3$, —$N^+C_4H_8O(R_1)$, —$N^+(R_1)(R_2)(CH_2CH_2OCH_3)$,

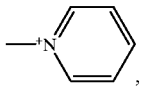

—$N^+(R_1)(R_2)(CH_2)_pC_6H_5$ and —$N^+(R_1)(R_2)(R_2)$ are cited, wherein $R_1$ and $R_2$ independently represent a hydrogen atom or an alkyl group with 1 to 6 carbon atoms, which may have a substituent; p, r and s independently represent an integer of 0 through 6; and q represents an integer of 1 through 20.

As examples of $Z^-$, $I^-$, $Cl^-$, $Br^-$, $CH_3SO_3^-$ and $CH_3$—$C_6H_4$—$SO_3^-$ are cited.

Hereunder, examples of the cationic fluorine-containing surfactants preferably used in the present invention will be exhibited. However, the present invention is not limited thereto.

FK-1
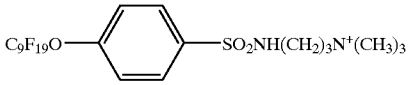
$I^-$
FK-2
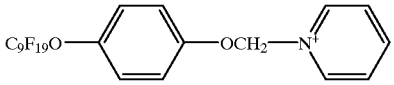
$Cl^-$
FK-3
$C_7F_{15}CONH(CH_2)_2N^+(CH_3)_3$
$Cl^-$
FK-4
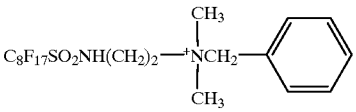
$Cl^-$
FK-5
$C_2F_5CONH(CH_2)_3N^+(CH_3)_3$ $I^-$
FK-6
$C_{12}F_{23}O(CH_2CH_2O)_5CH_2CH_2N^+(CH_3)_3$ $I^-$
FK-7
$C_9F_{17}O(CH_2)_3N^+(CH_3)_3$
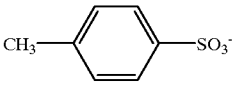
FK-8
$C_8F_{17}SO_2NH(CH_2)_3N^+(CH_3)_3$ $I^-$
FK-9
$C_8F_{17}SO_2NH(CH_2)_3N^+(CH_2CH_2OCH_3)_3$ $I^-$
FK-10
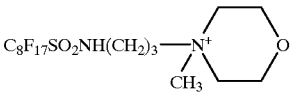
$I^-$
FK-11
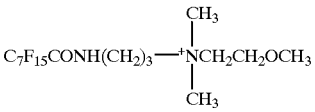
$Br^-$
FK-12
$C_9F_{19}CONH(CH_2)_5N^+(CH_3)_3$ $I^-$
FK-13
$C_8F_{17}SO_2NH(CH_2)_3OCH_2CH_2N^+(CH_3)_3$
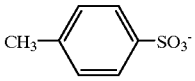
FK-14
$C_{12}F_{25}CONH(CH_2)_3OCH_2CH_2N^+(CH_3)_3$
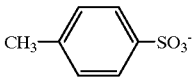
FK-15
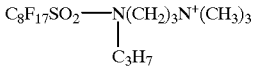
$I^-$
FK-16
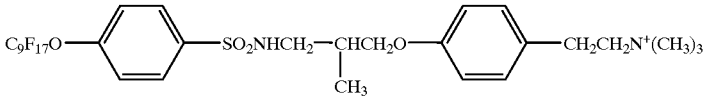
$I^-$
FK-17
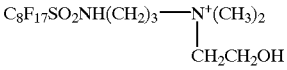
$Br^-$ -continued

FK-18

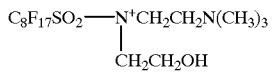

FK-19

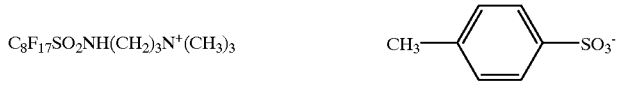

FK-20

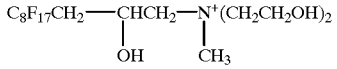

FK-21

The anionic fluorine-containing surfactants or the cationic fluorine-containing surfactants of the present invention can be synthesized by methods described in U.S. Pat. Nos. 2,559,751, 2,567,011, 2,732,398, 2,764,602, 2,806,866, 2,809,998, 2,915,376, 2,915,528, 2,918,501, 2,934,450, 2,937,098, 2,957,031, 3,472,894 and 3,555,089, British Patent Nos. 1,143,927 and 1,130,822, Japanese Patent Publication No. 37304/1970, Japanese Patent O.P.I. Nos. 9613/1972, 134614/1974, 117705/1975, 117727/1975, 121243/1975, 41182/1977 and 12392/1976, J. Chem, Soc., 1950, page 2789 and 1957, pp. 2574 and 2640, J. Amer. Chem. Soc., Volume 79, page 2549 (1957), J. Japan Oil Chemists Soc., Volume 12, page 653 and J. Org. Chem., Volume 30, page 3524 (1965).

Some of the above-mentioned fluorine-containing surfactants are commercially available as follows: Megafac F produced by DaiNippon Ink Chemical Industry Co, Ltd.; Fluorad FC produced by Minesota Mining and Manufacturing Company; Monflor produced by Imperial Chemical Industry; Zonyls produced by E. I. Du Pont Nemeras and Company; Licowet produced by Falbewereke Hexist.

The anionic fluorine-containing surfactants and the cationic fluorine-containing surfactants are preferably used in combination in view of the effect of the invention.

The total content of the anionic fluorine-containing surfactants and the cationic fluorine-containing surfactants is suitably 0.1 to 1,000 mg per $m^2$, preferably 0.5 to 300 mg per $m^2$, and more preferably 1.0 to 150 mg per $m^2$. Two or more kinds of each of the anionic fluorine-containing surfactants and the cationic fluorine-containing surfactants may be used. Another surfactant such as a nonionic fluorine-containing surfactant, a bataine type fluorine-containing surfactant or a hydrocarbon surfactant may be used combination.

The addition amount ratio of the anionic fluorine-containing surfactant to the cationic fluorine-containing surfactant in the invention is preferably 1:10 to 10:1 by mole ratio, and more preferably 3:7 to 7:3 by mole ratio.

In the invention, the ink receiving layer can be hardened with an appropriate hardener in order to improve water resistance and dot for dot reproduction. The example of the hardener includes aldehyde compounds such as formaldehyde and glutaraldehyde, ketone compounds such as diacetyl and chloropentanedion, bis(2-chloroethylurea), 2-hydroxy-4,6-dichloro-1,3,5-triazine, reactive halogen-containing compounds disclosed in U.S. Pat. No. 3,288,775, divinylsulfone, reactive olefin-containing compounds disclosed in U.S. Pat. No. 3,635,718, N-methylol compounds disclosed in U.S. Pat. No. 2,732,316, isocyanates disclosed in U.S. Pat. No. 3,103,437, aziridine compounds disclosed in U.S. Pat. Nos. 3,017,280 and 2,983,611, carbodiimides disclosed in U.S. Pat. No. 3,100,704, epoxy compounds disclosed in U.S. Pat. No. 3,091,537, a halogencarboxyaldehyde such as mucochloric acid, a dioxane derivative such as dihydroxy dioxane, and inorganic hardeners such as chromium alum, potash alum and zirconium sulfate. These hardeners can be used singly or in combination. The triazines, vinylsulfones or epoxy compounds are preferable. The addition amount of hardener is preferably 0.01 to 10 g, and more preferably 0.1 to 5 g based on 100 g of gelatin contained in the ink receiving layer.

The ink receiving layer in the invention may further contain, in addition to the above surfactant and hardener, various conventional additives such as inorganic pigment, colorants, colored pigment, a fixing agent for ink dyes, a UV absorber, an anti-oxidant, a dispersing agent, an anti-foaming agent, a leveling agent, an antiseptic agent, a brightening agent, a viscosity stabilizing agent and a pH adjusting agent.

The thickness of the ink receiving layer in the invention is preferably 0.5 to 100 $\mu$m, more preferably 1 to 70 $\mu$m, and most preferably 3 to 30 $\mu$m.

The recording sheet for ink jet recording in the invention is obtained by coating an ink receiving layer on a support. The support includes a hydrophobic substrate with no water absorption property, for example, a transparent or translucent film, or a resin-covered paper. The resulting sheet provides an image with excellent water resistance and excellent quality. As the substrate in the invention, a conventional one can be used. The transparent substrate, which includes a film or plate of polyester resins, cellulose acetate resins, acryl resins, polycarbonate resins, polyvinyl chloride resins, polyimide resins, cellophane or celluloid, and a glass plate. Of these, a polyester resin film is preferable and a polyethylene terephthalate film is especially preferable in view of stiffness and transparency.

The thickness of the transparent substrate in the invention is preferably 10 to 1000 $\mu$m, and more preferably 30 to 300 $\mu$m. The thickness of the translucent substrate in the invention is preferably 10 to 1000 $\mu$m, more preferably 30 to 300 $\mu$m, and most preferably 50 to 250 $\mu$m. The translucent substrate includes a synthetic paper, a resin-covered paper, a pigment-containing translucent film and a foaming film.

An especially preferable substrate is a film of a polyester resin such as polyethylene terephthalate or a resin-covered paper such as a photographic paper support. The most preferable embodiment of the recording sheet in the invention can be obtained by coating an ink receiving layer on such a substrate.

The base paper constituting the resin-covered paper preferably used in the invention is not specifically limited, and any conventional paper can be used, but a smooth paper used as a conventional photographic support is preferable. As pulp constituting the base paper, natural pulp, reproduction pulp or synthetic pulp is used singly or in admixture. These base papers may contain additives such as a sizing agent, a reinforcing agent, a filler, an anti-static agent, a fluorescent brightening agent or a dye which is usually used in paper manufacture. A surface sizing agent, a surface reinforcing agent, a fluorescent brightening agent, an antistatic agent and an anchoring agent may be coated on the surface of the material.

The thickness of the base paper is not specifically limited, but is preferably 10 to 200 $\mu$m. A base paper having a smooth surface is preferable, which is obtained by applying pressure to or calendering, paper, during or after papering. The weight of the base paper is preferably 30 to 250 g/m$^2$.

As the resin for the resin-covered paper, a polyolefin resin or a resin capable of being hardened with an electron beam can be used. The polyolefin resin includes an olefin homopolymer such as a low density polyethylene, a high density polyethylene, polypropylene or polypentene, an olefin copolymer such as ethylene-propylene copolymer or their mixture, each having various densities or melt viscosity indexes (melt index). These resins can be used singly or in combination.

The resin for the resin-covered paper preferably contains various additives, for example, white pigment such as titanium oxide, zinc oxide, talc or calcium carbonate, a fatty acid amide such as stearic acid amide or arachidic acid amide, a fatty acid metal salt such as zinc stearate, calcium stearate, aluminum stearate or magnesium stearate, an antioxidant such as Irganox 1010 or Irganox 1076, blue pigment or dyes such as cobalt blue, ultramarine, or phthalocyanine blue, magenta pigment or dyes such as cobalt violet, fast violet or manganese violet, a brightening agent and a UV absorber. These additives can be suitably used in combination.

The resin-covered paper, which is the support preferably used in the invention, is manufactured by a so-called extrusion method casting a thermally fused resin (for example, a fused polyolefin) on the moving paper, whereby both surfaces of the paper are covered with the resin. When the paper is covered with a resin capable of being hardened with electron beam irradiation, the resin is coated with a conventional coater such as a gravure coater or a blade coater and then is irradiated with electron beam to harden the coated resin. Before the paper is coated with a resin, the surface of the paper is preferably subjected to activation treatment such as corona discharge treatment or flame treatment. The surface of the support on the ink receiving layer side is glossy or matted depending upon its usage, and glossy surface is preferable. The back side of a support is not necessarily covered with a resin, but is preferably covered with a resin in view of prevention of curling. The back surface of a support is ordinarily non-glossy, but the back surface or both surfaces of the support are optionally subjected to activation treatment such as corona discharge treatment or flame treatment. The thickness of the resin is not specifically limited, but is ordinarily 5 to 50 $\mu$m.

A back coat layer can be provided on the substrate in the invention in view of anti-static property, transportability and anti-curling property. The back coat layer optionally contains an inorganic anti-static agent, an organic anti-static agent, a hydrophilic binder, latex, a hardener, pigment, a surfactant or a mixture thereof.

The water based ink used for ink jet recording in the invention is a recording liquid comprising the following colorants, solvents and other additives. The colorant includes a direct dye, an acid dye, a basic die, a reactive dye and food dyes.

The solvent for water based ink includes alkyl alcohols having 1 to 4 carbon atoms such as methyl alcohol, ethyl alcohol, isopropyl alcohol, butyl alcohol, sec-butyl alcohol, tert-butyl alcohol and iso-butyl alcohol, amides such as dimethylformamide and dimethylacetoamide, ketones or ketonealcohols such as acetone and diacetone alcohol, ethers such as tetrahydrofurane and dioxane, polyalkylene glycols such as polyethylene glycol and polypropylene glycol, alkylene glycols having 2 to 6 carbon atoms such as ethylene glycol, propylene, butylene glycol, triethylene glycol, 1,3, 6-hexane triol, hexylene glycol, thiodiglycol and diethylene glycol, polyhydric alcohol lower alkyl ethers such as glycerin, ethylene glycol methylether, diethylene glycol methyl (or ethyl)ether and triethylene glycol monomethylether, pyrrolidinones such as 2H-pyrrolidinone, and pyrrolidones such as 1-methyl-2-pyrrolidone and 2-pyrrolidone. Of these water soluble solvents, a polyhydric alcohol such as diethylene polyhydric alcohol lower alkyl ethers such as triethylene glycol monomethylether and triethylene glycol monoethylether, and pyrrolidones are preferable.

In the invention, the solvent for ink is preferably a mixture solvent of water and the above described organic solvent in view of prevention of ink head nozzle clogging. The mixture ratio of water to the organic solvent is preferably 30:70 to 70:30 by weight, and more preferably 40:60 to 70:30 by weight.

The another additive includes a pH adjusting agent, a metal chelating agent, an anti-fungal, a viscosity adjusting agent, a surface tension adjusting agent, a wetting agent, a brightening agent, a matting agent, a surfactant and an anti-rust agent.

As a coating method of an ink receiving layer coating solution, any conventional coating method (for example, a sizepress method, a roll coating method, a blade coating method, an air-knife method, a gate roll coating method, a curtain method, and an extrusion method method) can be used. As described above, a coating composition for an ink receiving layer can be incorporated in the support by adding an ink receiving layer composition in to pulp slurry and papering.

The drying method after the coating is not limited, but a cold dry method disclosed in on page 3 of Japanese Patent O.P.I. Publication No. 6-64306 in view of a recording sheet with high quality.

EXAMPLES

The invention will be detailed in the following examples, but the invention is not limited thereto. In the examples, "parts" refers to weight parts, unless otherwise specified.

Example 1

The ink receiving layer coating solution having the following composition was coated on a commercially available woodfree paper by a bar coating method to give an ink receiving layer with a dry thickness of about 10 $\mu$m. Thus, ink jet recording sheet samples 1-1 through 1-15 were obtained.

| | |
|---|---|
| Lime-processed gelatin (KV-3000 produced by Konica Gelatin Corporation) | 98.2 parts |
| Exemplified compounds | as shown in Table 1 |
| Surfactant FA | 0.15 parts |
| Surfactant FK | 0.15 parts |
| Surfactant FT | 0.5 parts |
| Organic matting agent | 1 part |

*the solid content of the solution: 8 weight/volume %
*The pH of the coating solution was adjusted to 7.5 employing an aqueous 5 weight/volume % NaOH solution.

Organic matting agent

Polymethylmethacrylate-ethyleneglycol dimethacrylate copolymer (Average particle size of 7 to 15 μm)

Surfactant FA

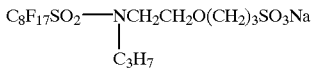

Surfactant FK

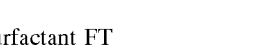

Surfactant FT

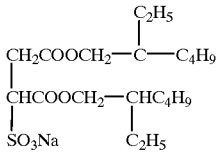

Each of the resulting samples was stored for one month at 35° C. and 80% RH. The b* values in the CIELAB coordinate of the ink receiving layer surface before and after the storage were measured through a color difference meter SPM50 made by Gretag Co. Ltd., and A b* was counted by subtracting the b* value after the storage from the b* value before the storage. Further, an image tone was visually observed. The evaluation criteria are as follows:

A: The b* value is less than 0.1, with no change of the image tone observed.

B: The b* value is 0.1 to less than 0.15, with slight image tone change, which is not problematic for commercial use.

C: The b value is 0.15 to less than 0.20, with slight image tone change to a yellow color, which is not problematic for commercial use.

D: The b* value is 0.20 to less than 0.40, with marked image tone change to a yellow color, which is problematic for commercial use.

E: The b* value is 0.40 or more, and can not be put into practical use.

The results are shown in Table 1.

TABLE 1

| Sample No. | Exemplified compounds/addition amount (mg/m$^2$) | Evaluation |
|---|---|---|
| 1-1 | — | E |
| 1-2 | Dye/1.0 | E |
| 1-3 | a-1/0.01 | C |
| 1-4 | a-1/0.03 | B |

TABLE 1-continued

| Sample No. | Exemplified compounds/addition amount (mg/m$^2$) | Evaluation |
|---|---|---|
| 1-5 | a-1/0.05 | B |
| 1-6 | a-1/0.08 | B |
| 1-7 | a-1/0.1 | A |
| 1-8 | a-1/0.5 | A |
| 1-9 | a-1/0.8 | A |
| 1-10 | a-1/1.0 | A |
| 1-11 | a-1/3.0 | A |
| 1-12 | a-1/5.0 | B |
| 1-13 | a-1/8.0 | B |
| 1-14 | a-1/10.5 | C |
| 1-15 | a-1/12.0 | C |

Dye: Direct Fast Yellow (produced by Sumitomo Kagaku Co., Ltd.), which is outside the formula (I) compound As is apparent from Table 1, the samples employing the compounds in the invention provide excellent storage stability, reduced color tone change after high humidity storage, and excellent color image. On the contrary, the samples, which do not employ the compounds in the invention, provide a color image shift to yellow after high humidity storage and a poor yellowish color image, resulting in poor color image.

Example 2

The commercially available polyethylene-covered paper used had a polyethylene layer consisting of 70 parts of low density polyethylene, 20 parts of high density polyethylene and 10 parts of titanium oxide which was coated on one side of a paper base having a basis weight of 100 g to be 25 g/m$^2$, and a polyethylene layer consisting of 50 parts of low density polyethylene and 50 parts of high density polyethylene which was coated on the other side of the paper base to be 25 g/m$^2$. On the polyethylene-covered paper or a commercially available white polyethylene terephthalate film support with a thickness of 100 μm was coated the ink receiving layer coating solution prepared in Example 1 with a bar coating method, and then dried to obtain an ink receiving layer with a dry thickness of 10 μm. Thus, ink jet recording sheet samples were obtained, and evaluated in the same manner as in Example 1.

The samples employing the compounds in the invention provide the same excellent storage stability as in Example 1, and further provide a smooth and glossy image with high quality and without ink blurring.

Example 3

On the polyethylene-covered paper used in Example 2 was coated the ink receiving layer coating solution having the following composition with a bar coating method, and dried to obtain an ink receiving layer with a dry thickness of 10 μm. Thus, an ink jet recording sheet sample was obtained.

| | |
|---|---|
| Lime-processed gelatin (KV-3000 produced by Konica Gelatin Corporation) | 50.0 parts |
| Polyethylene glycol Cerasol 100A (produced by Meisei Kagaku Co., Ltd.) | 48.7 parts |
| Exemplified compound a-4 | 0.025 parts |
| Surfactant FA | 0.15 parts |

-continued

| | |
|---|---|
| Surfactant FK | 0.15 parts |
| Surfactant FT | 0.5 parts |
| Organic matting agent | 1 part |

*the solid content of the solution: 8 weight/volume %
*The pH of the coating solution was adjusted to 7.5 employing an aqueous 5 weight/volume % NaOH solution.

The resulting sample was evaluated in the same manner as in Example 1, and the results provided the same excellent storage stability as Example 1. Further, solid images of B, G and R were printed employing an Ink jet printer BJC-600J (produced by Canon Co., Ltd.), and the resulting image provided markedly reduced unevenness of image density and uniform images as compared with the sample prepared in Example 2.

Example 4

On a polyethylene terephthalate film support were coated the ink receiving layer coating solutions having the following compositions. Thus, recording sheet samples 4-1 through 4-8 were obtained.

| | |
|---|---|
| First layer (lowermost layer) | |
| Lime-processed gelatin (KV-3000 produced by Konica Gelatin Corporation) | 1.2 g/m$^2$ |
| Polyvinyl pyrrolidone K-90 (produced by BASF Co., Ltd.) | 0.8 g/m$^2$ |
| Exemplified compounds | Kinds and their amounts shown in Table 2 |
| Second layer | |
| Lime-processed gelatin (KV-3000 produced by Konica Gelatin Corporation) | 5.0 g/m$^2$ |
| Polyvinyl pyrrolidone K-90 (produced by BASF Co., Ltd.) | 3.0 g/m$^2$ |
| Polyurethane F-8438D (produced by Daiichi Kogyo Yakuhin Co., Ltd.) | 2.0 g/m$^2$ |
| Polyethylene glycol 200000 (produced by Merk Co., Ltd.) | 1.0 g/m$^2$ |
| Third layer (uppermost layer) | |
| Lime-processed gelatin (KV-3000 produced by Konica Gelatin Corporation) | 0.5 g/m$^2$ |
| Polyvinyl pyrrolidone K-90 (produced by BASF Co., Ltd.) | 0.4 g/m$^2$ |
| Polyurethane F-8438D (produced by Daiichi Kogyo Yakuhin Co., Ltd.) | 0.4 g/m$^2$ |
| Polyethylene glycol 200000 (produced by Merk Co., Ltd.) | 0.2 g/m$^2$ |
| Surfactant FA | 3 mg/m$^2$ |
| Surfactant FK | 3 mg/m$^2$ |
| Surfactant FT | 20 mg/m$^2$ |
| Matting agent | 60 mg/m$^2$ |

In the samples obtained above, the first layer, second layer and third layer were coated on the support in that order.

Each of the resulting samples was stored for 60 days at 35° C. and 80% RH. The b* values in the CIELAB coordinate of the ink receiving layer surface before and after the storage were measured through a color difference meter SPM50 made by Gretag Co. Ltd., in the same manner as in Example 1, and Δ b* was counted by subtracting the b* value after the storage from the b* value before the storage. Further, an image tone was visually observed. The results are shown in Table 2.

TABLE 2

| Sample No. | Exemplified compounds/addition amount (mg/m$^2$) | Exemplified compounds/addition amount (mg/m$^2$) | Evaluation |
|---|---|---|---|
| 4-1 | b-4/2.5 | — | B |
| 4-2 | c-4/2.5 | — | B |
| 4-3 | d-18/2.5 | — | C |
| 4-4 | a-8/2.5 | a-30/0.21 | A |
| 4-5 | a-8/2.7 | a-30/0.21 | A |
| 4-6 | a-8/2.9 | a-30/0.21 | A |
| 4-7 | a-8/2.7 | a-30/0.26 | A |
| 4-8 | a-8/2.7 | a-30/0.16 | A |

As is apparent from Table 2, the samples employing two kinds of the compounds in the invention provide more excellent storage stability, more reduced color tone change after high humidity storage, and more excellent color image as compared with the samples employing only one kind of the compounds in the invention.

Example 5

On the polyethylene-covered paper used in Example 2 were coated the ink receiving layer coating solutions having the following compositions with a slide hopper coating method, and then dried to obtain ink receiving layers with a dry thickness as shown in Table 3. Thus, ink jet recording sheet samples 5-1 through 5-5 were obtained.

| Ink receiving layer coating composition | |
|---|---|
| Lime-processed gelatin (KV-3000 produced by Konica Gelatin Corporation) | 50 parts |
| Polyvinyl pyrrolidone K-90 (produced by BASF Co., Ltd.) | 20 parts |
| Modified polyvinyl alcohol (Ecomaty AX produced by Nihon Gosei Kagaku Co., Ltd.) (Polyoxyalkylene grafted compound of a vinyl alcohol-allyl alcohol copolymer) | 30 parts |
| Exemplified compound FA-19 | as shown in Table 3 |
| Exemplified compound FK-21 | as shown in Table 3 |
| Exemplified compound a-16 | as shown in Table 3 |

The above coating composition was dissolved in deionized water to obtain the solid content of 80 g/liter, and the pH of the resulting coating solution was adjusted to 7.5 employing an aqueous NaOH solution.

The resulting samples were evaluated as follows:

1. Storage stability of color tone after high humidity storage

The storage stability was evaluated in the same manner as in Example 1.

2. Color tone change at images with a lower density due to light

The white and gray checkered images were printed in the color mode employing a color ink jet printer MJ-810C (produced by Seiko-Epson Co., Ltd.) to obtain a gray image with a density of about 0.3. The resulting image was exposed for 24 hours to a 70,000 lux light employing a Xenon Fade-O-Meter, and any color tone change was visually observed. The results are shown in Table 3, and evaluated according to the following five criteria:

A: Little color tone change observed, exhibiting an excellent image

B: A little color tone change observed, but still a good image

C: Color tone change observed, but no problem

D: Considerable color tone change observed, at a problematic level

E: Prominent color tone change observed

TABLE 3

| | Ink receiving layer coating composition | | | | | Evaluation | |
|---|---|---|---|---|---|---|---|
| Sample No. | Layers* | Dry thickness (μm) | Compound a-16 (mg/m²) | Surfactant FA-19 (mg/m²) | Surfactant FK-21 (mg/m²) | Storage stability | Color tone change |
| 5-1 | First | 2 | 3.0 | — | — | A | A |
| | Second | 3 | — | — | — | | |
| | Third | 5 | — | 0.15 | 0.15 | | |
| 5-2 | First | 3 | 2.4 | — | — | B | A |
| | Second | 2 | 0.6 | — | — | | |
| | Third | 5 | — | 0.15 | 0.15 | | |
| 5-3 | First | 5 | 2.4 | — | — | B | B |
| | Second | 2 | 0.6 | — | — | | |
| | Third | 3 | — | 0.15 | 0.15 | | |
| 5-4 | First | 7 | 2.4 | — | — | B | C |
| | Second | 1 | 0.6 | — | — | | |
| | Third | 2 | — | 0.15 | 0.15 | | |
| 5-5 | First | 5 | — | — | — | E | E |
| | Second | 2 | — | — | — | | |
| | Third | 3 | — | 0.15 | 0.15 | | |

*The first layer, second layer and third layer were coated on the support in that order.

As is apparent from Table 3, employing the compound in the invention provides reduced color change after high humidity storage. Employing the compound in the invention layers other than the uppermost layer (furthest from the support) provides reduced color tone change due to light in images with a lower density. Further, more excellent results are obtained by localizing not less than 80 weight % of the compound in the ink receiving layer within 50% (preferably within 30%) of the layer thickness, measured from the support.

What is claimed is:

1. A recording sheet for ink-jet recording comprising a support, and provided on one side of the support, an ink receiving layer, wherein the ink receiving layer contains binder and 0.01 to 10 Mg/m² of a compound represented by formula I:

formula I

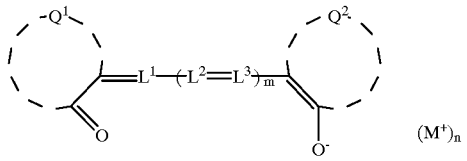

wherein $Q^1$ and $Q^2$ independently represent a non-metallic atomic group necessary to form a nitrogen-containing heterocyclic ring; $L^1$, $L^2$, and $L^3$ independently represent a methine group; M represents a cationic group; m represents an integer of 0 to 4; and n is 1.

2. The recording sheet for ink-jet recording of claim 1 wherein said binder is a water soluble polymer.

3. The recording sheet for ink-jet recording of claim 2, wherein the water soluble polymer is selected from the group consisting of gelatin, polyvinyl pyrrolidones, polyvinyl alcohols and polyalkylene glycols.

4. The recording sheet for ink-jet recording of claim 1, wherein the support is comprised of a hydrophobic substrate.

5. The recording sheet for ink-jet recording of claim 4, wherein the hydrophobic substrate is a resin-coated paper in which a resin is provided on both sides of a base paper.

6. The recording sheet for ink-jet recording of claim 5, wherein the resin is polyolefin.

7. The recording sheet for ink-jet recording of claim 6, wherein the polyolefin is polyethylene.

8. The recording sheet for ink-jet recording of claim 4, wherein the hydrophobic substrate is a polyester resin film.

9. The recording sheet for ink-jet recording of claim 8, wherein the polyester resin film is a polyethylene terephthalate film.

10. The recording sheet for ink-jet recording of claim 1, wherein the ink receiving layer contains at least two compounds represented by said formula I.

11. The recording sheet for ink-jet recording of claim 1, wherein the compound represented by said formula I is localized at portions closer to the support in the ink receiving layer.

12. The recording sheet for ink-jet recording of claim 11, wherein 80 weight % or more of the compound represented by said formula I is localized in the ink receiving layer within 50% of the ink receiving layer thickness, measured from the support.

13. The recording sheet for ink-jet recording of claim 1, wherein the ink receiving layer consists of at least two layers a nd the ink receiving layer closest to the support contains the compound represented by said formula I.

14. An ink jet recording method employing a color ink jet recording procedure, the method comprising:

jetting ink on an ink jet recording sheet comprising a support, and provided on one side of the support, an ink receiving layer, wherein the ink receiving layer contains a binder and 0.01 to 10 g/m² of a compound represented by formula I:

formula I

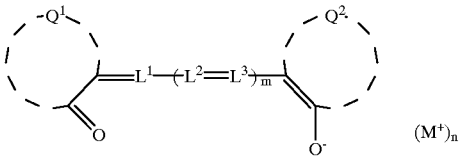

wherein $Q^1$ and $Q^2$ independently represent a non-metallic atomic group necessary to form a nitrogen-containing heterocyclic ring; $L^1$, $L^2$, and $L^3$ independently represent a methine group; M represents a cationic group; m represents an integer of 0 to 4; and n is 1.

15. A recording sheet for ink-jet recording comprising a support, and provided on one side of the support, an ink receiving layer, wherein the ink receiving layer contains a binder and a compound represented by formula I-a, I-b, I-c, I-d or I-e:

formula I-a

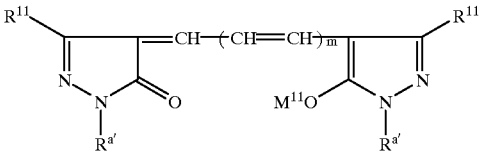

formula I-b

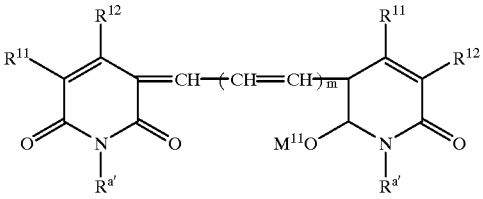

formula I-c

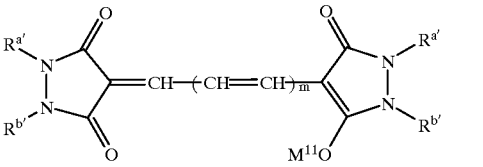

-continued formula I-d

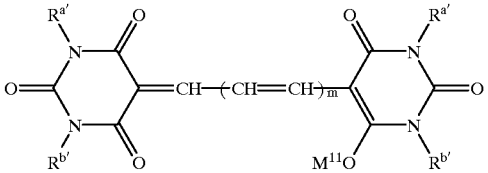

formula I-e

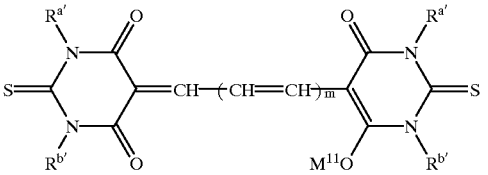

wherein $R^{11}$ and $R^{12}$ independently represent a hydrogen atom, an alkyl group, an aryl group, a heterocyclic group, a carbamoyl group, an amino group, a hydroxy group, a carboxyl group, an alkyloxycarbonyl group, an aryloxycarbonyl group, a cyano group, an acyl group, a sulfamoyl group, an alkoxy group, or an aryloxy group; $R^a$ and $R^b$ independently represent a hydrogen atom, an alkyl group, an aryl group, a heterocyclic group, a carbamoyl group, or a sulfonyl group; and $M^{11}$ represents a hydrogen ion, an alkali metal ion, an ammonium ion, or an organic ammonium ion; and m represents an integer of 0 to 4.

16. The recording sheet for ink-jet recording of claim 15 wherein the content of the compound in the ink receiving layer is 0.01 to 10 $mg/m^2$.

* * * * *